US005941474A

United States Patent [19]

Cushing

[11] Patent Number: 5,941,474

[45] Date of Patent: Aug. 24, 1999

[54] SYSTEM, APPARATUS AND METHOD FOR UNLOADING AND LOADING WINDER SHAFTS

[75] Inventor: Darrell D. Cushing, Danville, Ky.

[73] Assignee: Huntsman Packaging Corporation, Salt Lake City, Utah

[21] Appl. No.: 08/946,236

[22] Filed: Oct. 7, 1997

Related U.S. Application Data

[63] Continuation-in-part of application No. 08/891,818, Jul. 14, 1997, abandoned

[60] Provisional application No. 60/021,829, Jul. 16, 1996, and provisional application No. 60/028,086, Oct. 7, 1996.

[51] Int. Cl.[6] ..... B65H 19/30

[52] U.S. Cl. ..... 242/533.1; 242/533.2; 242/533.7; 242/530.1

[58] Field of Search ..... 242/530.1, 530.3, 242/530.4, 533.1, 533.2, 533.3, 533.4, 533.5, 533.6, 533.7, 533.8, 598.2

[56] References Cited

U.S. PATENT DOCUMENTS

| | | | |
|---|---|---|---|
| 3,096,039 | 7/1963 | Doven | 242/598.2 |
| 3,424,398 | 1/1969 | Garnier | 242/533.7 |
| 3,727,854 | 4/1973 | Grotzbach | 242/533.2 |
| 3,729,102 | 4/1973 | Shumaker | 242/533.7 |
| 3,733,035 | 5/1973 | Schott | 242/533.7 |
| 3,844,501 | 10/1974 | Spencer . | |
| 3,869,046 | 3/1975 | Gerhart | 242/533.7 |
| 4,030,681 | 6/1977 | Schott, Jr. . | |
| 4,208,019 | 6/1980 | Dusenbery | 242/533.4 |
| 4,223,851 | 9/1980 | Lewallyn | 242/533.2 |
| 4,360,170 | 11/1982 | Kuklies et al. . | |
| 4,541,583 | 9/1985 | Forman et al. . | |
| 4,695,005 | 9/1987 | Gietman | 242/533.7 |
| 4,715,552 | 12/1987 | Matsumoto . | |
| 4,955,554 | 9/1990 | LeBoeuf et al. . | |
| 5,035,373 | 7/1991 | Perrigo . | |
| 5,042,272 | 8/1991 | Furr | 242/533.2 |
| 5,054,708 | 10/1991 | Wiggers | 242/533.7 |
| 5,531,398 | 7/1996 | Krska | 242/533.7 |
| 5,660,350 | 8/1997 | Byrne et al. | 242/533.4 |

OTHER PUBLICATIONS

"Automatic Handling, Inc." Video Tape.
"CAFUS #1" Video Tape, Aug. 1, 1996.

*Primary Examiner*—John M. Jillions
*Attorney, Agent, or Firm*—Arnold, White & Durkee

[57] ABSTRACT

Systems and methods for unloading wound production rolls from the shaft of a winder and for reloading the winder shaft with cores in preparation for further winding. These systems and methods may be employed with multiple turret swing-out winders of the type typically employed to wind continuous webs of sheet material, such as plastic film, onto individual rolls.

55 Claims, 18 Drawing Sheets

SYSTEM, APPARATUS AND METHOD FOR UNLOADING AND LOADING WINDER SHAFTS

The present application is a continuation-in-part of copending U.S. patent application Ser. No. 08/891,818 filed Jul. 14, 1997, entitled "System, Apparatus and Method for Unloading and Loading Winder Shafts," by Darrell D. Cushing now abandoned which was a non-provisional application claiming priority on provisional patent application Ser. No. 60/021,829 filed Jul. 16, 1996, entitled "System, Apparatus and Method for Unloading-Reloading of Rolls," by Darrell D. Cushing. This application also claims priority on provisional patent application Ser. No. 60/028,086 filed Oct. 7, 1996, entitled "System, Apparatus and Method for the Unloading of Full Production Rolls and the Reloading of Empty (New) Cores," by Darrell D. Cushing. The entire text of each of the above-referenced disclosures is specifically incorporated by reference herein without disclaimer.

BACKGROUND OF THE INVENTION

1. Field of the Invention

This invention relates generally to systems for winding continuous webs of sheet material, such as plastic film, onto cores to form individual rolls. More particularly, this invention relates to apparatus and methods for unloading wound production rolls from the shaft of a winder, such as a swing-out winder, and for loading or reloading the winder shaft with empty cores in preparation for further winding.

2. Description of the Related Art

A roll of sheet material is typically formed by winding a continuous web of sheet material onto a core, typically in a winding machine that is capable of winding a plurality of cores simultaneously. In this regard, automatic winding machines employing one or more swing-out shafts may be used. Winding machines having shafts mounted on a rotating turret are also typically employed. One such machine is known as a cantilevered winding machine. In the operation of a typical cantilevered winding machine, two swing-out winding shafts are typically employed. The use of two winding shafts allows plastic film to be wound on a plurality of cores on a first shaft at the same time wound rolls on a second shaft are unloaded and replaced with cores. When the cores on the first shaft have been fully wound with sheet material, the turret is rotated so that the cores on the second shaft are placed in position within the winding machine for winding, and so that the wound rolls on the first shaft may be removed and replaced with cores. This process is typically repeated over and over during the winding operation.

In most cases, a winder is capable of winding rolls of sheet material faster than the rolls may be replaced with cores. In typical winding operations, wound production rolls are typically unloaded from a winding shaft by hand, and cores are typically loaded onto a winding shaft by hand. Operations employing hand loading and unloading usually require at least about one minute and 15 seconds or more, depending on the number of rolls being wound, to prepare a winding shaft for further winding by replacing wound rolls with cores. However, a typical winder is capable of winding a set of cores with about 1200 feet to about 1800 feet of sheet material in less than about one minute. Therefore, the efficiency of a typical film winding operation is usually dependent on the time required for replacing wound rolls with cores on a winding shaft. Furthermore, typical conventional winding operations require more than one person, typically three people, to accomplish core loading, winding, and roll unloading.

SUMMARY OF THE INVENTION

The disclosed method and apparatus relate to a system for the automatic mechanical unloading of wound production rolls of sheet material, such as plastic film, from a winder shaft, and for the automatic mechanical reloading of cores onto the winder shaft. As used herein, "mechanical" as used to describe methods or steps means that the steps or methods are carried out by machine or apparatus rather than by hand. Advantageously, the automatic mechanical nature of one embodiment of the system may be used to allow rapid replacement of a plurality of axially aligned wound rolls with a plurality of axially aligned cores in a time period of less than about a minute, more typically less than about 45 seconds, and most typically less than about 30 seconds per loading cycle, thereby greatly increasing the efficiency of winding operations. Furthermore, the disclosed system may be operated by as few as one person. In one embodiment, the system is particularly adapted for a single turret swingout arbor-type winder for plastic film; e.g., a polyethylene winder.

Embodiments of the disclosed method and apparatus are typically employed with winders equipped with a movable (e.g., pivotable) shaft which is capable of moving between a production loading use position, in which film, paper, textile, etc., is rolled onto cores on the shaft, and a non-use unloading position from which wound rolls may be removed from the shaft and cores replaced. Such winders may employ multiple pivotable shafts attached to a turret, for example, to allow cores on one shaft to be wound while the other shaft/s is unloaded and reloaded, thus increasing winding capacity. For example, in one embodiment of the production of polyethylene stretch wrap film, a plurality of cores (e.g., 4–6) are wound to form a roll having a diameter of about 8–10" and a length of about 10–20". In such an embodiment, the system of the disclosed method and apparatus allows production rolls to be quickly removed from the shaft and new cores to be quickly placed on the shaft.

In one embodiment, the system may include a container or carriage with dividers which is capable of holding and feeding cores to a core rack capable of holding a plurality of cores in an arrangement as desired on the winder shaft. The dividers within the carriage may be adjusted for variations in length of the cores which may be supplied at one side of the carriage.

The system may also include a movable frame, for example, positioned adjacent one side of the carriage. The movable frame may be configured with a core loading rack and a roll conveyor on its free end, with the movable frame being adapted to pivot about its fixed end and move typically pivotally between a receiving position in which the roll conveyor receives loaded production rolls picked from the winder shaft in the non-use position, and a loading position wherein cores received in the core loading rack from the carriage are axially aligned with the empty winder shaft and then pushed by a core loader onto the shaft and the shaft then moved back to the production use position in the winder.

In one embodiment of the system, the winder shaft moves to an outward, angular, non-use unloading position, and the production rolls are removed from the shaft directly onto a roll conveyor or other production roll receptor. The core loading rack, which is integrally movable with the conveyor on the movable frame, receives a plurality of selected, axially aligned cores therein from a core dispensing opening in the carriage, and then pivots with the movable frame to align the cores held in the core rack with the angularly positioned empty shaft. The cores on the core loading rack are then pushed onto the end of the outward shaft, and the shaft moved back to the production position, while the movable frame pivots back also, so that the core loading rack may receive cores for the next cycle.

In one respect then, this invention is a winder shaft unloading and loading apparatus, including a frame having an upper end and a lower end. The frame may be pivotable about its lower end, having an axis of pivot. A core loader including a core rack may be connected to the frame in generally parallel relationship with the axis of pivot of the frame. A roll conveyor may be positioned proximate the core loader and connected to the frame in generally parallel relationship with the axis of pivot of the frame. The invention may also include a core carriage adapted to contain cores, a core feeder operable to dispense cores from within the core carriage to the core loader, and a roll remover positioned in operative relationship with the shaft of the winder. In one embodiment, the frame may be adapted to be positioned adjacent a free end of a shaft of the winder such that the core loader and the roll conveyor may be alternately axially aligned with the free end of the winder shaft by pivoting the frame. In another embodiment, the core carriage may include one or more bins and the core feeder may include a conveyor having one or more trays supported by one or more chain and sprocket conveyors, with the core feeder positioned in operative relationship with the core carriage to simultaneously dispense a row of one or more cores from the bins to the core loader. In another embodiment, the core carriage may include a container for the cores configured to store the cores stacked on their sides in generally parallel relation. In this regard, the container may include a core dispenser positioned in a wall of the container, and the core feeder may include an inclined core conveyor extending upward within the container configured to receive cores from the stack and to convey the received cores to the core dispenser. In another embodiment, the frame may be vertically disposed and positioned alongside the container and the dispenser with the lower end of the frame pivotally mounted and the upper end of the frame movable between a first position alongside the container and the dispenser and a second position away from the container and dispenser. In this embodiment, the core loader may be disposed adjacent the upper end of the frame and adapted to receive cores from the container when the frame is in the first position. In another embodiment, the core loader may be positioned between the core carriage and the roll conveyor, the roll conveyor may be positioned parallel to the core loader, and the roll conveyor may be configured to support the rolls and be operable to convey the rolls. In another embodiment, the inclined conveyor may include a plurality of trays disposed transversely along the core conveyor, with each the tray being configured to receive a row of cores. In another embodiment, the roll conveyor and the core loader are disposed vertically such that a roll on the roll conveyor when the frame is in the first position and a core on the core loader when the frame is in the second position have substantially the same longitudinal axes. In another embodiment, the winder shaft may have a fixed end and a free end. In this embodiment, the roll remover may include an overhead trolley and a roll removal end, with the roll removal end being connected to the overhead trolley and being disposed adjacent the winder shaft. Further in this embodiment, the overhead trolley may be adapted to move in a path so that the roll removal end travels back and forth in a direction adjacent and parallel to the winder shaft between a position adjacent the fixed end of the winder shaft and a position adjacent the free end of the winder shaft. In a further embodiment, the winder shaft may be a winder shaft pivotable between a winding position and an outward unloading position, and the frame may be positioned so that the core loader and the roll conveyor may be alternately axially aligned with the free end of the winder shaft when the shaft is positioned in the outward unloading position. In another embodiment, the core loading rack may include a core cradle having a longitudinal axis and first and second ends. In this embodiment, the core cradle may be adapted to receive cores from the core feeder, and the core loader may further include a core ram disposed in adjacent operative relationship with the core cradle and a driver connected to the core ram, with the driver being adapted to travel in a path along the cradle longitudinal axis and between the first and second ends of the core cradle to displace the cores from the cradle. In other another embodiment, the driver may be a rodless air cylinder having a longitudinal axis disposed in adjacent parallel relationship with the longitudinal axis of the core cradle. In another embodiment, the roll conveyor may be a conveyor belt. In a further embodiment, the apparatus may include an unloading/loading system controller programmable for controlling operation of the apparatus.

In yet another respect, this invention is a method of unloading and loading a winder shaft, in which an unloading and loading apparatus is provided that includes: a frame having an upper end and a lower end, the frame being pivotable about its lower end and having an axis of pivot; a core loader connected to the frame in generally parallel relationship with the axis of pivot of the frame, the core loader including a core loading rack; a roll conveyor connected to the frame in generally parallel relationship with the axis of pivot of the frame, the roll conveyor being positioned proximate the core loader; a core carriage adapted to contain cores, a core feeder operable to dispense cores from within the core carriage to the core loading rack; and a roll remover positioned in operative relationship with the shaft of the winder. In this respect, the method includes: providing one or more rolls on the shaft, positioning the frame about its pivot axis so that the roll conveyor is axially aligned with the shaft, axially moving the rolls from the shaft onto the roll conveyor with the roll remover, removing a row of cores from the core carriage and placing the cores on the core loading rack with the core feeder, positioning the frame about its pivot axis so that the core loading rack is axially aligned with the winder shaft; and axially moving the cores from the core loading rack onto the shaft with the core loader. In one embodiment of this method, the winder shaft may be a winder shaft pivotable between a winding position and an outward unloading position, and the frame may be positioned so that the core loader and the roll conveyor may be alternately axially aligned with the free end of the winder shaft when the shaft is positioned in the outward unloading position, and may further include: placing the winder shaft in an outward unloading position prior to axially moving the rolls from the shaft, and placing the winder shaft in a winding position after axially moving the cores from the core loading rack onto the shaft. In another embodiment of this method, the shaft may be a first pivotable shaft of a dual cantilevered shaft turret winder having first and second pivotable shafts and a turret, and may further include: rotating the turret to place the second shaft in an inside winder station and to place the first shaft in an outside winder station prior to placing the first shaft in outward unloading position, and rotating the turret to place the first shaft in an inside winder station and the second shaft in an outside winder station after placing the first shaft in winding position. In another embodiment of this method, the core carriage may include one or more bins and the core feeder may include a conveyor having one or more trays supported by one or more chain and sprocket conveyors, with the core feeder being positioned in operative relationship with the core carriage to simultaneously dispense a row of one or more cores from the bins to the core loading rack. In another embodiment of this method, the winder shaft may have a fixed end and a free end, the roll remover may include an overhead trolley and a roll removal end with the roll removal end being connected to the overhead trolley and being disposed adjacent the winder shaft, and the overhead trolley may be adapted to move in a path so that the roll removal end travels back and forth in a direction adjacent and parallel to the winder shaft between a position adjacent the fixed end of the winder shaft and a position adjacent the free end of the winder shaft. In this embodiment, the rolls are axially moved from the shaft onto the roll conveyor by moving the overhead trolley from the position adjacent the fixed end of the winder shaft to the position adjacent the free end of the winder shaft, thereby causing the roll removal end to contact the rolls and axially move the rolls onto the roll conveyor. In another embodiment of this method, the core loading rack may further include a core cradle having a longitudinal axis and first and second ends, with the core cradle being adapted to receive cores from the core feeder, and the core loader may farther include: a core ram disposed in adjacent operative relationship with the core cradle and a driver connected to the core ram, the driver being adapted to travel in a path along the cradle longitudinal axis and between the first and second ends of the core cradle to displace the cores from the cradle. In another embodiment of this method, the driver may be a rodless air cylinder having a longitudinal axis disposed in adjacent parallel relationship with the longitudinal axis of the core cradle. In another embodiment of this method, the roll conveyor may be a conveyor belt. In another embodiment of this method, the unloading and loading apparatus may further include an unloading/loading system controller and may further comprise controlling the unloading and loading apparatus with the controller.

In another respect, this invention is a winder shaft loading and roll conveying apparatus, including a core loader that includes a core mechanical displacement device operable to mechanically move cores onto a first end of the shaft, a roll conveyor operable to mechanically transport rolls away from the first end of the shaft, and in which the core loading rack and the roll conveyor are disposed in operative relationship such that the core loading rack and the roll conveyor may be alternately axially aligned with the first end of the winder shaft.

In yet another respect, this invention is a core storing and dispensing apparatus, including a core carriage configured to hold at least two columns of cores stacked on their sides in generally parallel relation, and a core feeder adapted to simultaneously remove one core from each of the columns and to simultaneously dispense the cores removed from each of the columns in end to end relationship.

In yet another respect, this invention is a winder shaft unloading apparatus, including a roll mechanical displacement device operable to mechanically displace rolls off a first end of the shaft, and in which the roll mechanical displacement device is positioned in overhead relationship with the winder shaft.

In yet another respect, this invention is a method of mechanically loading and unloading cores in the operation of a winding machine having at least one shaft. The method includes providing rolls on the shaft, mechanically displacing the rolls from a first end of the shaft, and mechanically displacing cores onto the first end of the shaft. In one embodiment of this method, the winding machine may have at least one shaft pivotable about one end between a winding position and an unloading position, and the method may further include: alternately and mechanically aligning the shaft when in its unloading position with a core loader containing cores and with a roll conveyor operable to convey rolls away from the shaft, mechanically pivoting the shaft to its unloading position and in alignment with the roll conveyor after providing rolls on the shaft, mechanically displacing the rolls from a first end of the shaft onto the roll conveyor and conveying the displaced cores from the first end of the shaft, mechanically moving the roll conveyor out of alignment with the shaft and aligning the core loader with the shaft, mechanically displacing the cores from the core loader onto the first end of the shaft, and pivoting the shaft to its winding position.

In yet another respect, this invention is a winder shaft unloading and loading apparatus, typically including a frame having a first end and a second end defining a first axis therebetween, the frame being movable between first and second positions in relation to the frame first axis. A core loader including a core loading rack is typically connected to the frame in generally parallel relationship with the first axis of the frame, and a roll conveyor is typically connected to the frame in generally parallel relationship with the first axis of the frame so that the roll conveyor is positioned proximate the core loader. The apparatus also typically includes a core carriage adapted to contain cores, the core carriage being operable to dispense cores from within the core carriage to the core loader when the frame is in the first position, and also typically includes a roll remover positioned in operative relationship with the shaft of the winder. The frame may be movable in a reciprocating direction with respect to the first frame axis. The frame may have an upper end and a lower end, the frame being pivotable about its lower end and having an axis of pivot. The core carriage may include one or more bins having a bin bottom in which a core opening is defined that may be operable to gravity feed cores from within the core carriage to the core loader when the frame is in the first position. A roll remover comprising an overhead trolley and roll removal end as discussed elsewhere herein may be employed.

In yet another respect, this invention is a method of unloading and loading a winder shaft, typically including the step of providing an unloading and loading apparatus that typically includes: a frame having a first end and a second end defining a first axis therebetween, the frame being movable between first and second positions in relation to the frame first axis; a core loader connected to the frame in generally parallel relationship with the first axis of the frame, the core loader including a core loading rack; a roll conveyor connected to the frame in generally parallel relationship with the first axis of the frame, the roll conveyor being positioned proximate the core loader; a core carriage adapted to contain cores, the core carriage being operable to dispense cores from within the core carriage to the core loader when the frame is in the first position; and a roll remover positioned in operative relationship with the shaft of the winder. The method also typically includes the steps of providing one or more rolls on the shaft, positioning the frame so that the roll conveyor is axially aligned with the shaft and so that a row of cores are dispensed from the core carriage to the core loading rack, axially moving the rolls from the shaft onto the roll conveyor with the roll remover, positioning the frame so that the core loading rack is axially aligned with the winder shaft, and axially moving the cores from the core loading rack onto the shaft with the core loader.

In yet another respect, this invention is a winder shaft unloading and loading apparatus, typically including a frame having a first end and a second end defining a first axis therebetween, and with the frame being movable between first and second positions is in a reciprocating direction in relation to the frame first axis. A core loader including a core loading rack is typically connected to the frame in generally parallel relationship with the first axis of the frame, and a roll conveyor is typically connected to the frame in generally parallel relationship with the first axis of the frame, the roll conveyor being positioned proximate the core loader. In this respect, this invention also typically includes a core carriage adapted to contain cores, the core carriage having a core opening defined therein, the core opening operable to dispense cores from within the core carriage to the core loader when the frame is in the first position, and a roll remover positioned in operative relationship with the shaft of the winder. The reciprocating direction may be substantially perpendicular to the first frame axis. The core carriage may include one or more bins having a bin bottom, the core opening being defined in the bin bottom and being positioned in operative relationship with the frame to simultaneously dispense a row of one or more cores from the bins to the core loader. The core carriage may also include a container for the cores configured to store the cores stacked on their sides in generally parallel relation and include a core opening positioned in a bottom of the container. The bottom of the container may be inclined downward toward the core opening to gravity feed the cores from the stack to the core loader. The movable frame may be disposed beneath the container, so that the core loader is disposed beneath the core opening to receive cores from the container when the frame is in the first position, and so that the core loader is disposed alongside the container when the frame is in the second position. The core loading rack of the core loader may further include a core recess defined within the frame adjacent and coextensive to the core cradle, the core recess being adapted to receive a single row of cores from the core opening when the frame is in the first position, and the frame may further include a top which prevents additional cores from being dispensed from the core opening when the frame is moved from the first position to the second position. The frame may be movably disposed within an interior space defined in the core carriage; and the frame may be movably connected to the core carriage.

In yet another respect, this invention is a method of unloading and loading a winder shaft, typically including the steps of providing an unloading and loading apparatus that includes: a frame having a first end and a second end defining a first axis therebetween, the frame being movable between first and second positions in a reciprocating direction in relation to the frame first axis; a core loader connected to the frame in generally parallel relationship with the first axis of the frame, the core loader including a core loading rack; a roll conveyor connected to the frame in generally parallel relationship with the first axis of the frame, the roll conveyor being positioned proximate the core loader; a core carriage adapted to contain cores, the core carriage having a core opening defined therein, the core opening operable to dispense cores from within the core carriage to the core loader when the frame is in the first position; and a roll remover positioned in operative relationship with the shaft of the winder. This method also typically includes the steps of providing one or more rolls on the shaft, positioning the frame so that the roll conveyor is axially aligned with the shaft and so that a row of cores are dispensed from the core carriage through the core opening to the core loading rack, axially moving the rolls from the shaft onto the roll conveyor with the roll remover, positioning the frame so that the core loading rack is axially aligned with the winder shaft, and axially moving the cores from the core loading rack onto the shaft with the core loader.

In yet another respect, this invention is a winder shaft loading and roll conveying apparatus, typically including a movable frame that is movable between a first position and a second position, a core loader connected to the frame that includes a core loading rack, a roll conveyor connected to the frame in generally parallel relationship with the core loader, and a core carriage including a core opening to gravity feed cores from the container to the core loader. The movable frame may be positioned so that the core loading rack is disposed beneath the core opening to receive cores from the core opener when the frame is in the first position, and the core loading rack and the roll conveyor are typically disposed in operative relationship such that the roll conveyor and the core loading rack may be alternately axially aligned with the first end of the winder shaft by moving the movable frame from the first position to the second position. In one embodiment, the core carriage may include one or more bins having a bin bottom, the core opening being defined in the bin bottom and being positioned in operative relationship with the movable frame to simultaneously dispense a row of one or more cores from the bins to the core loader. In another embodiment, the core carriage may include a container for the cores configured to store the cores stacked on their sides in generally parallel relation, the container including a core opening positioned in a bottom of the container; and the bottom inclined downward toward the core opening to gravity feed the cores from the stack to the core loader. The movable frame may be movably disposed within an interior space defined in the core carriage; and the movable frame may be movably connected to the core carriage. Among other things, the movable frame may be a pivoting or reciprocating frame.

In yet another respect, this invention is a method of unloading and loading a winder shaft, typically including the steps of providing an unloading and loading apparatus that includes: a movable frame, the frame being movable between a first position and a second position; a core loader connected to the frame, the core loader including a core loading rack; a roll conveyor connected to the frame in generally parallel relationship with the core loader; a core carriage including a core opening to gravity feed cores from the container to the core loader; and a roll remover positioned in operative relationship with the shaft of the winder. In this respect, the method also typically includes the steps of providing one or more rolls on the shaft, positioning the frame so that the roll conveyor is axially aligned with the shaft and so that the core loading rack is disposed beneath the core opening and so that a row of one or more cores are gravity dispensed from the core carriage through the core opening to the core loading rack, axially moving the rolls from the shaft onto the roll conveyor with the roll remover, positioning the frame so that the core loading rack is axially aligned with the winder shaft, and axially moving the cores from the core loading rack onto the shaft with the core loader. Among other things, the movable frame may be pivoting or reciprocating frame.

DESCRIPTION OF ILLUSTRATIVE EMBODIMENTS

Figure 1:
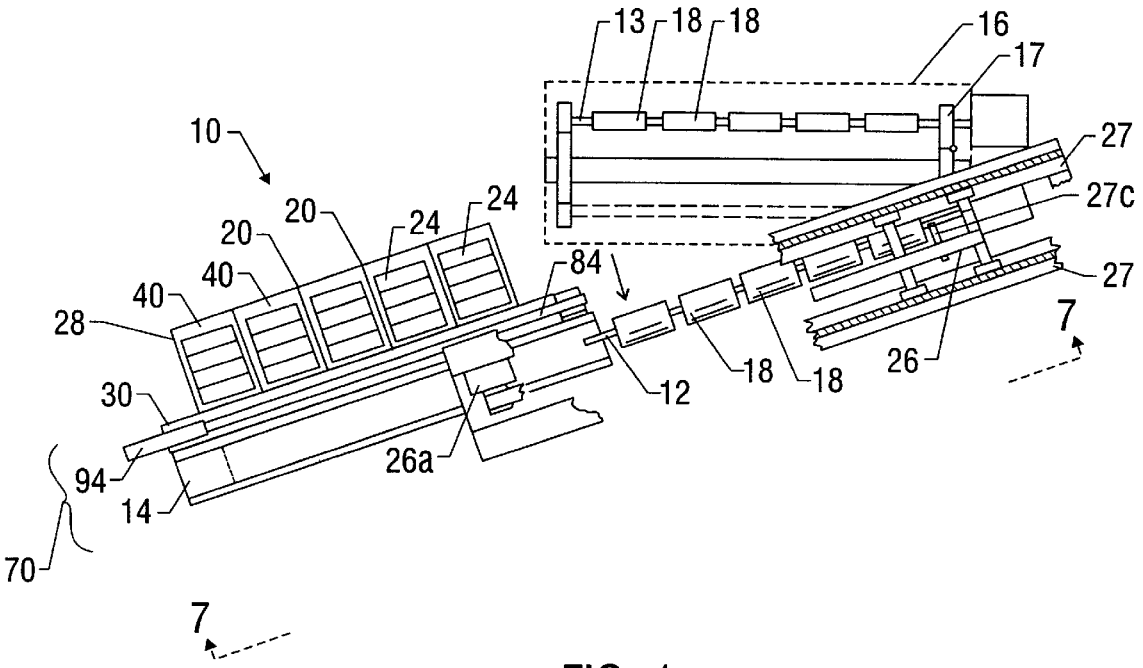
FIG. 1 is a simplified overhead view showing an arrangement of a core carriage, core rack, roll conveyor, movable frame, overhead trolley and winder according to one embodiment of the disclosed method and apparatus.

In the drawings, FIGS. 1–6 are simplified schematic representations of one embodiment of the disclosed system and method. FIG. 1 is an overhead view showing a winder and unloader/loader system combination 10 with the core carriage 28 having cores 24 stored therein in a stacked manner. Adjustable dividers 20 permit the user to adjust for variations in number and lengths of the cores 24 to be wound, and the system 10 includes a core loading rack 30 and roll conveyor 14 for loading and unloading the cores 24 onto and off from a pivotable shaft 12 of winder 16. As shown, core loading rack 30 and roll conveyor 14 are typically elongated in shape for receiving a plurality of cores and rolls, respectively. As used herein, "core" means any object suitable for loading on a winder shaft and winding with material within a winding machine, most typically, but not limited to, cylindrical empty cardboard cores for being wound with sheet material as described further herein. For example, it will be understood with benefit of the present disclosure that a core may also be an empty core partially wound with sheet material that is to be loaded onto a shaft for further winding. As used herein, "roll" or "wound roll" means any object suitable for unloading from a winder shaft after winding with material within a winding machine, most typically, but not limited to, a roll fully wound with material as described further herein. For example, it will be understood with benefit of the present disclosure that a roll may also be a partially wound roll that is to be removed from a winding shaft.

Figure 6:
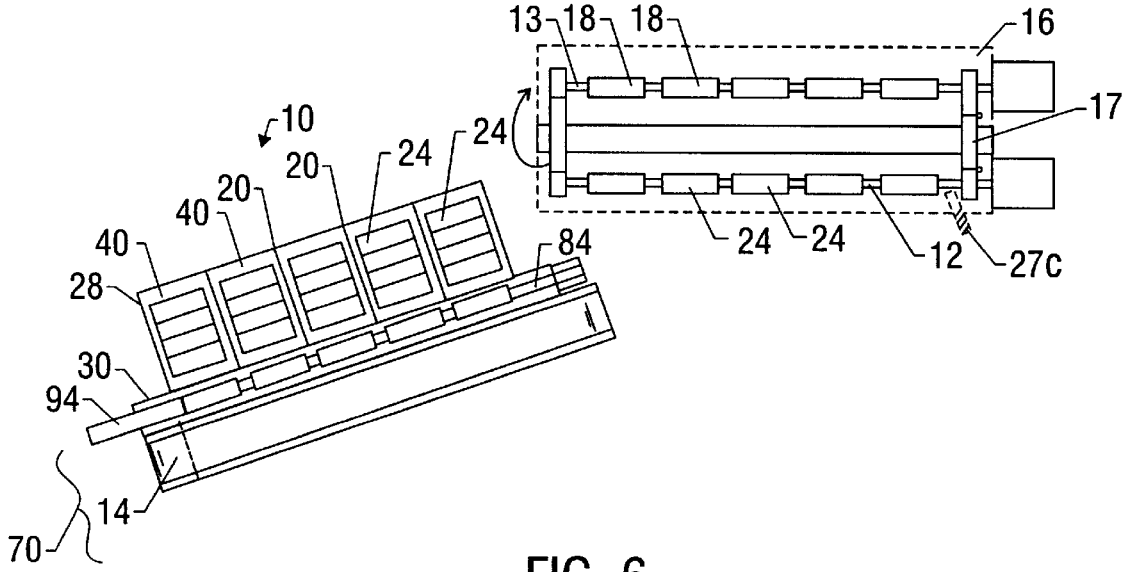
FIG. 6 is a simplified overhead view showing an arrangement of a core carriage, core rack, roll conveyor, movable frame and winder according to one embodiment of the disclosed method and apparatus.

In the illustrated embodiment, pivotable shaft 12 is one shaft of a single turret two shaft cantilevered winder 16 having a second pivotable shaft 13 and rotatable turret 17. One example of such a winder is a Gloucester Model 1002S winder having two 3 inch diameter by 104" long shafts and is available from Gloucester Engineering of Gloucester, Mass. However, any other type of single turret two shaft cantilevered winder may also be used in the practice of the disclosed method and apparatus including, but not limited to, winders having other shaft diameters and lengths, as well as winders available from other manufacturers. In the case of such a winder, turret 17 is capable of rotating, thereby alternately placing each shaft in an inside winder station (as shaft 13 is depicted in FIG. 1) and an outside winder station (as shaft 12 is depicted in FIG. 1). Each shaft 12 and 13 has a fixed end adjacent turret 17 and when placed in an outside winder station is capable of pivoting its free end (opposite to the fixed end) back and forth between a winding position (as shaft 12 is depicted in FIG. 6) and an angular outward loading position (as shaft 12 is depicted in FIG. 1). Further, it will be understood that a non-pivotable cantilevered shaft may also have a fixed end (where it is supported) and a free or cantilevered (unsupported) end, as well.

In angular outward loading position, each shaft 12 and 13 may be axially aligned alternatively with core rack 30 for mechanically loading cores 24 onto the shaft or with roll conveyor 14 for mechanically unloading and removing wound rolls from the shaft, as shown in FIGS. 1–7. Also as shown in FIGS. 1–7, overhead trolley 26 is positioned to mechanically unload wound rolls 18 from shaft 12 onto conveyor 14. The other shaft 13 is shown in an inside winding station within winder 16. In the figures, rolls 18 represent fully wound rolls, partially wound rolls, or rolls in the process of being wound within a winder.

Although a single turret dual shaft cantilevered winder is illustrated in FIGS. 1–7 in combination with the disclosed unloading and loading system, it will be understood with benefit of this disclosure that the disclosed system may be practiced in combination with other types of winders as well. Examples of other suitable types of winders that may be employed include, but are not limited to, winders having single shafts or more than two shafts, turretless and multiple turret winders, and/or winders having shafts capable of winding a greater or lesser number of rolls than that illustrated and described. Furthermore, the disclosed method and apparatus may be employed with winding equipment used to wind a wide variety of sheet material including, but not limited to, plastic, paper, textile and other sheet materials known in the art.

Figure 10:
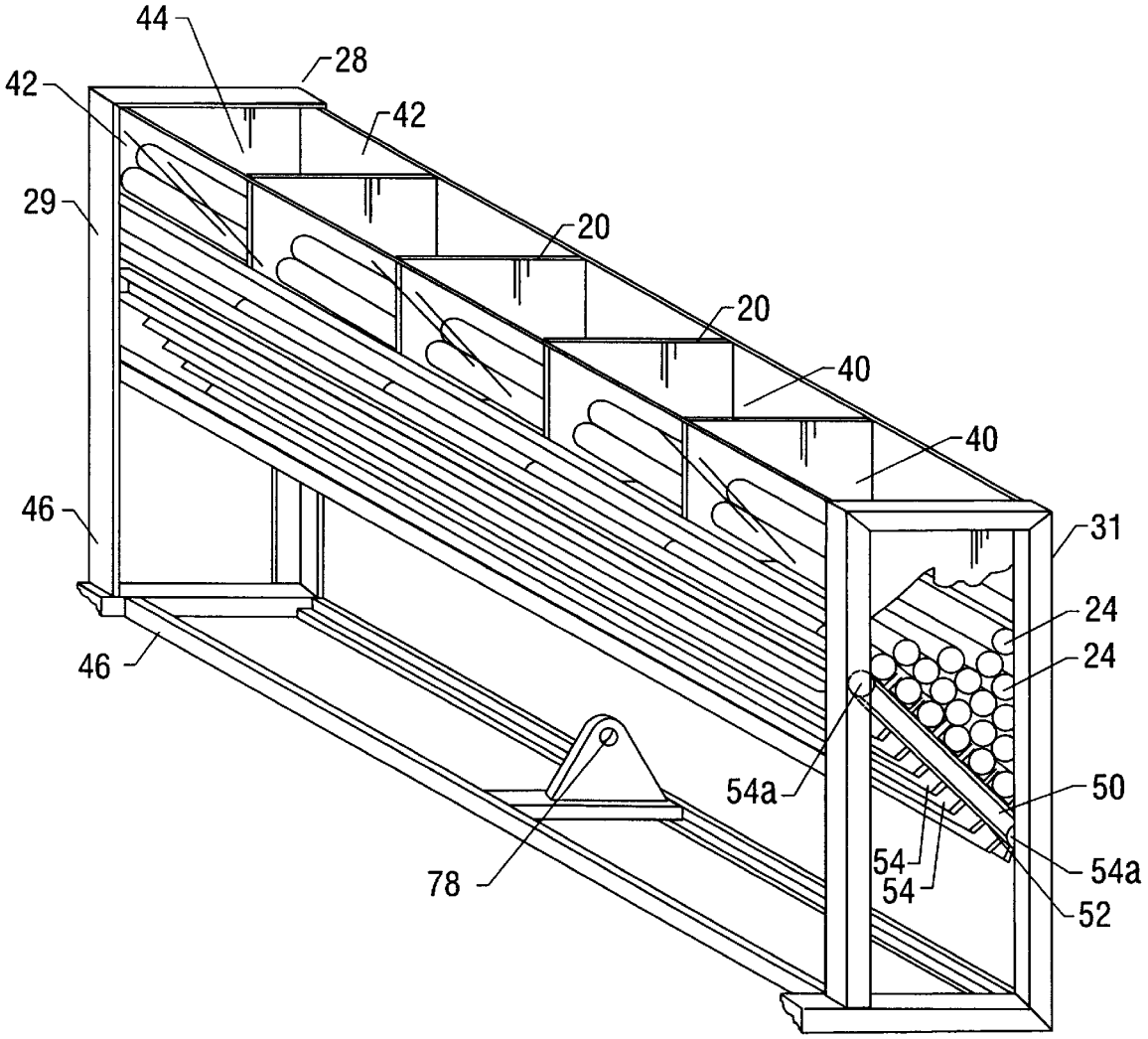
FIG. 10 is a simplified perspective view of a core carriage and core conveyor according to one embodiment of the disclosed method and apparatus.

FIG. 10 illustrates one typical embodiment of core carriage 28. As illustrated in FIG. 10, carriage 28 includes an enclosed container of dimensions suitable for containing a plurality of cores 24 in one or more bins 40, in this case five rows of 3" diameter by 20" long cores for holding polyethylene film, such as "pallet wrap." These cores may be constructed of any suitable core material known in the art, although most typically are constructed of cardboard. Carriage dividers 20 for separating the interior of carriage 28 into columns or multiple bins 40 of cores are optional, though typically employed. Dividers 20 are typically removable and adjustable, so as to allow creation of multiple bins 40 that accommodate cores having different lengths. Adjustable dividers 20 are typically constructed to be adjustable by hand. Typically, dividers are constructed of "LEXAN" and are about 0.5 inch thick, although other materials and/or divider thicknesses suitable for separating rows of cores or otherwise preventing cores from overlapping each other may be employed. Other suitable divider materials include, but are not limited to, plastic, Plexiglas, and wood (such as plywood, etc.). Divider thickness may be greater or lesser than about 0.5 inch.

In one embodiment, carriage 28 is typically configured with carriage frame members 46 (typically 4"×4"×3/16" steel members) and transparent plastic walls 42 so that the number of cores 24 present within carriage 28 may be viewed from outside the carriage. As shown in FIG. 10, upper end 44 of carriage 28 is typically open to allow cores to be restocked as necessary from the top. Restocking may be performed by hand or by mechanical equipment. Upper end 44 may also be optionally covered with a removable top, if desired.

Although one embodiment of carriage 28 is illustrated in FIG. 10 holding five columns or bins of cores, it will be understood with benefit of the present disclosure that a carriage may be dimensioned to contain as few as one row, column or bin, or to contain as many rows, columns or bins of cores as desired to match the core carrying capacity of the particular winder shaft/s being employed. In addition, a carriage may be constructed of solid opaque materials, such as metal, wood, plastic, etc. A carriage frame may be of any suitably sturdy material, such as wood, plastic, etc. Furthermore, a carriage may be constructed with a frame capable of containing cores without the need for carriage walls.

A carriage may also be configured to contain or handle virtually any type and/or size (i.e., length and diameter) of cores desired. For example, a carriage may be configured to handle empty core types including, but not limited to, polyvinyl chloride (PVC) or paper cores, or such cores partially wound or coated with other materials. Moreover, cores having virtually any internal or external diameter and length suitable for winding in a given winding machine or for placement on a given winder shaft may be employed. In one embodiment, cores having an internal diameter of about 3 inches, an external diameter of about 3.5 to about 3.75 inches, a length of between about 10 inches and about 20 inches, and wall thickness of between about 0.25 and about 0.5 inch are typically handled. In this embodiment, cores having a length of about 14 inches are typically handled, although cores having lengths greater than about 20 inches and less than about 10 inches may also be wound with appropriate adjustment in divider placement to accommodate the varying core lengths when dividers are used. For example, in the present embodiment carriage 20 may be configured to handle one or more individual cores having a combined length of up to about 100 inches or less when placed in core carriage 20. In this regard, specific examples include, but are not limited to, ten 10 inch long cores, five 10 inch long cores and one 50 inch long core, two 40 inch long cores, two 40 inch long cores and one 20 inch long core, two 50 inch long cores, one 100 inch long core, or any other combination of cores having a total combined length of 100 inches or less. Furthermore, it will be understood with benefit of this disclosure that other embodiments may include a core carriage and associated equipment suitable for handling cores having a combined total length of greater or less than about 100 inches.

Although cores having an internal diameter of about 3 inches are typically handled with the disclosed method and apparatus, cores having an internal diameter greater than or less than about 3 inches may also be handled. Specific examples of other core sizes that may be handled include, but are not limited to, cores having an internal diameter of between about 3 inches and about 12 inches, more typically between about 6 inches and about 12 inches, and most typically about 6 inches, although core sizes having internal diameters of greater than 12 inches may also be handled. Similarly, external core diameter may vary accordingly. It will be understood with benefit of the present disclosure that, in order to handle cores of varying sizes, equipment associated with the disclosed apparatus may require adjustment in size. For example, larger core trays and core dispensing opening (both described below), may be required to handle cores of larger size, or smaller core trays may be required to handle smaller diameter cores so as to prevent simultaneous feeding of more than one core into each core tray. Furthermore, cores having wall thicknesses greater than about 0.5 inch and less than about 0.25 inch may also be handled.

FIG. 8–10 and 16 show a core feeder for mechanically feeding a row of cores. A core feeder is typically a conveyor or conveyor belt 50 having one or more chains 52 for supporting core trays 54 in movable relationship beneath cores 24 stacked in bins 40. Conveyor belt 50 is typically powered electrically, but may be powered by any other suitable means known in the art, such as pneumatically, hydraulically, etc. As illustrated, core conveyor 50 is typically angled upwards at about 45 degrees toward the front wall 29 of carriage 28, in which a core dispensing opening 60 is disposed, although a core conveyor may be positioned at other angles, or with the front wall as well. The back wall 31 of carriage 28 is typically enclosed or otherwise blocked in order to contain cores 24. In this regard, core conveyor 50 is typically contained within the back and side walls of carriage 20.

Figure 9:
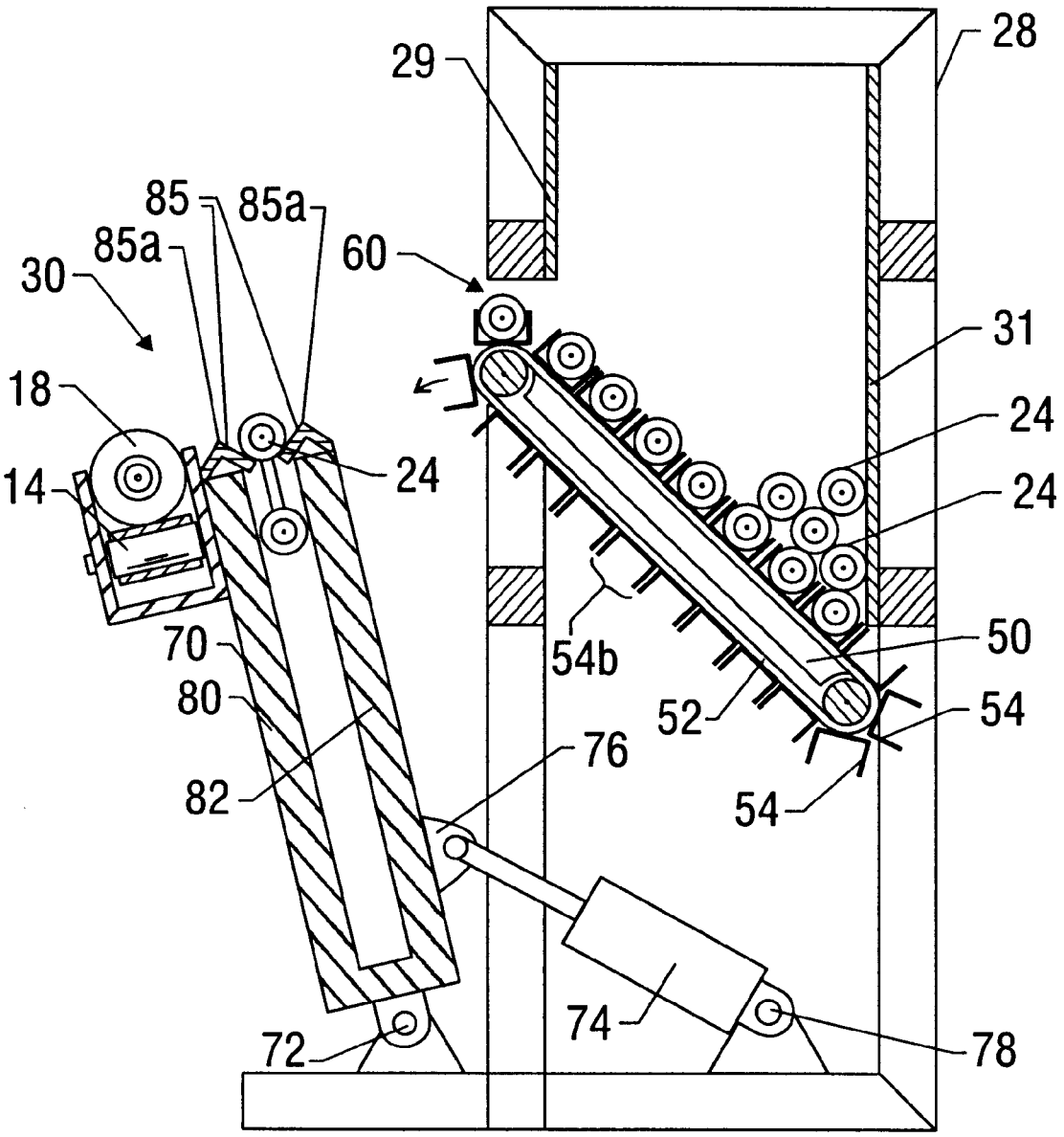
FIG. 9 is a simplified cross sectional view of a core carriage, core rack, roll conveyor and movable frame according to one embodiment of the disclosed method and apparatus.

As shown in FIG. 10, trays 54 are typically configured in a "U" shape in order to receive and hold one row of cores, although any shape suitable for receiving and conveying cores 24 may be employed. By "row" of cores, it is meant a row of a desired number of cores placed end to end and ready for placement on a winder shaft. Advantageously, this arrangement allows a full load of cores for a winder shaft to be simultaneously dispensed, saving time. Core trays 54 are typically configured for receiving 3 inch internal diameter cores and typically have tray sides with a height of about 4 inches, a width 54*b* of about 4 inches (as shown in FIG. 9), and are typically manufactured of 3/16 inch steel, although any other material suitable for containing and transporting cores may also be employed. As shown, trays 54 are typically oriented in a longitudinal direction parallel to the direction of cores 24. Typically, about 15 trays are employed, although any number of trays suitable for conveying cores to opening 60 may be employed. In this regard, as few as one tray, for example, that makes a complete revolution around a wheel or belt with each loading cycle, may be employed. In the embodiment of FIG. 10, each end of each tray 54 is typically mounted to a chain that is supported on a pair of sprockets 54*a* (referred to herein as a "chain and sprocket conveyor") present at each end of carriage 28. Although two chain and sprocket conveyors (two chains and two pairs of sockets) are typically employed with one chain and sprocket conveyor disposed at each end of carriage 28, additional chain and sprocket conveyors may also be employed in any suitable position for supporting core trays 54 in movable relationship with carriage 28.

Figure 16:
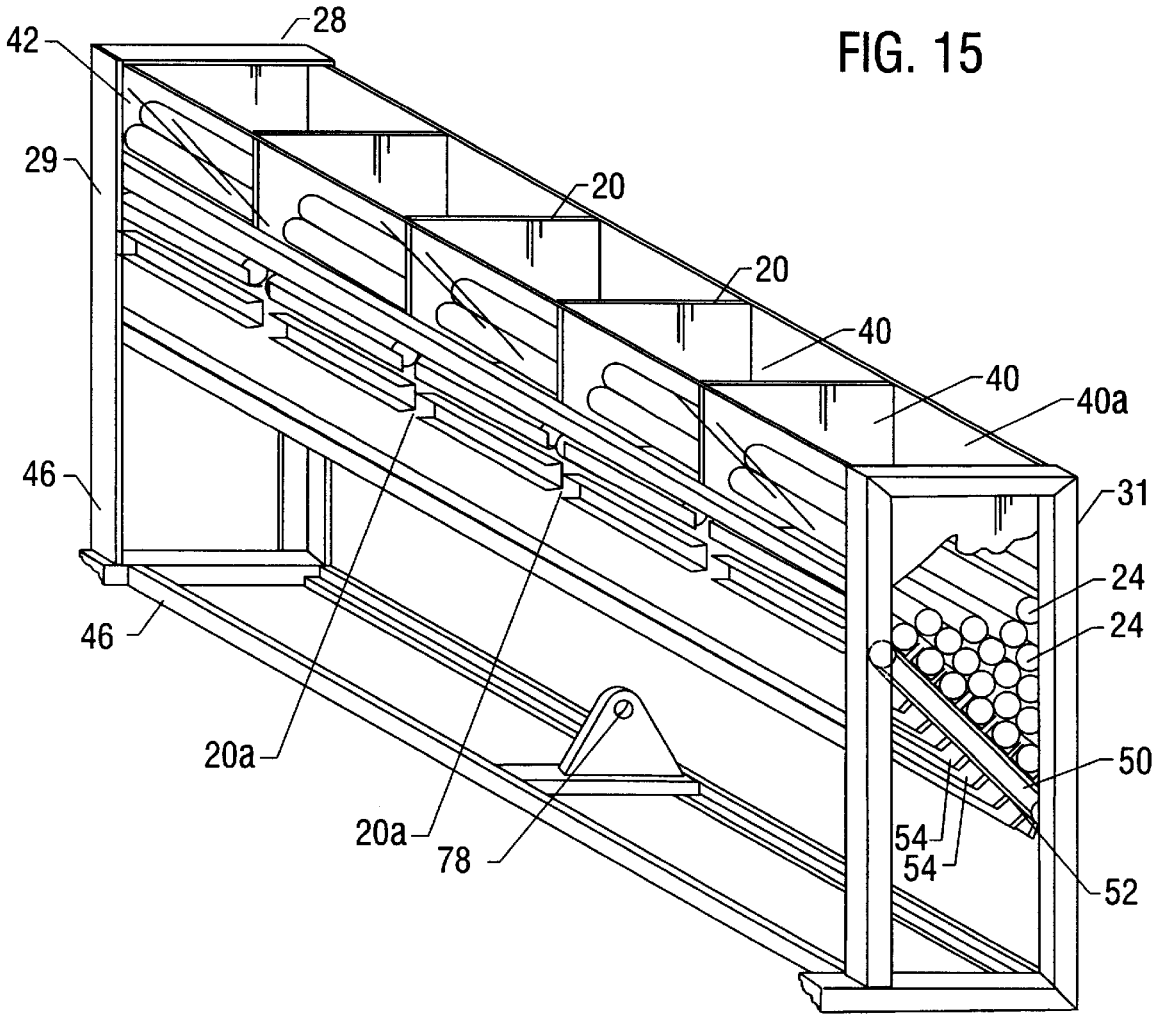
FIG. 16 is a simplified perspective view of a core carriage and core conveyor according to one embodiment of the disclosed method and apparatus.

Trays 54 may be of any suitable design, including of continuous longitudinal construction as shown in FIG. 10, of segmented construction as shown in FIG. 16 so as to create openings 20*a* into which dividers 20 may extend, or of other suitable design. In any case, sufficient clearance to allow conveyor 50 to rotate freely, while at the same time maintaining cores 24 segregated into separate bins (when they are employed), is typically provided. FIG. 16 also illustrates an alternate embodiment of carriage 28 having bins 40 enclosed with a carriage top 40*a*. In this regard carriage top 40*a* may be permanent, removable, segmented, etc. Furthermore, an opening for loading cores may optionally be provided in carriage back wall 31 in any embodiment of carriage 28. If segmented trays are employed as illustrated in FIG. 16, at least one chain and pair of sprockets is typically employed for supporting each column of segmented trays in moveable relationship with carriage 28.

As indicated by the arrow in FIG. 8, the upper half of conveyor 50 is typically configured to rotate in a direction from the back wall 31 towards opening 60, such that the portion of each tray 54 beneath each core bin 40 receives one or more cores and conveys them upwards and towards opening 60, where they are discharged into a core loading rack 30 (hereinafter described). Advantageously, this allows simultaneous mechanical loading of a plurality of cores into a core rack as a single row in one step or motion of core conveyor 50, as opposed to previous methods in which individual cores are loaded one by one onto a core rack, and which may take about one minute and a half or greater per loading cycle to complete. This makes it possible for the disclosed method and apparatus to greatly improve the efficiency of the winder loading process.

Although a typical embodiment of a core conveyor is illustrated in FIGS. 8–10 and 16, it will be understood with benefit of this disclosure that a core conveyor may employ, for example, any tray and chain type conveyor belt known in the art that is suitable for receiving and conveying cores. For example, it will be understood with benefit of the present disclosure that other combinations of trays and belts, chains, or other suitable drive devices are possible. For example, other suitable core conveyor combinations may include belts or chains with protruding fins rather than U-shaped trays. Furthermore, a core feeder may also be any type of apparatus other than a conveyor belt suitable for conveying or otherwise feeding cores into a core tray 30.

In the illustrated embodiments, a core loader including a core mechanical displacement device is typically provided for driving or otherwise mechanically moving or placing cores onto a winder shaft. In one embodiment, a core loader includes a core loading rack 30 that is typically disposed such that its longitudinal axis is in adjacent parallel relationship with the longitudinal axis of a roll conveyor 14, and such that it is adjacent core dispensing opening 60 for receiving cores from core conveyor 50. As shown in FIGS. 1 and 9, core loading rack 30 is typically formed by adjacently parallel mounted rack frame members 80 and 82, which form a longitudinal cradle 84 in which cores 24 may be supported as shown. Frame members 80 and 82 of core loading rack 30 may be constructed of steel or other suitably strong frame material, and typically have edges 85 angled inward at about 45° at the point of contact with cores 24, such as may be formed by inverted segments 85*a* of 2 inch angle iron (as shown in FIGS. 8, 9, 11 and 12). However, edges 85 may be of any configuration suitable for forming a cradle 84 or other surface having a longitudinal axis upon which cores 24 may slide or be driven toward a winder shaft 12.

Figure 12:
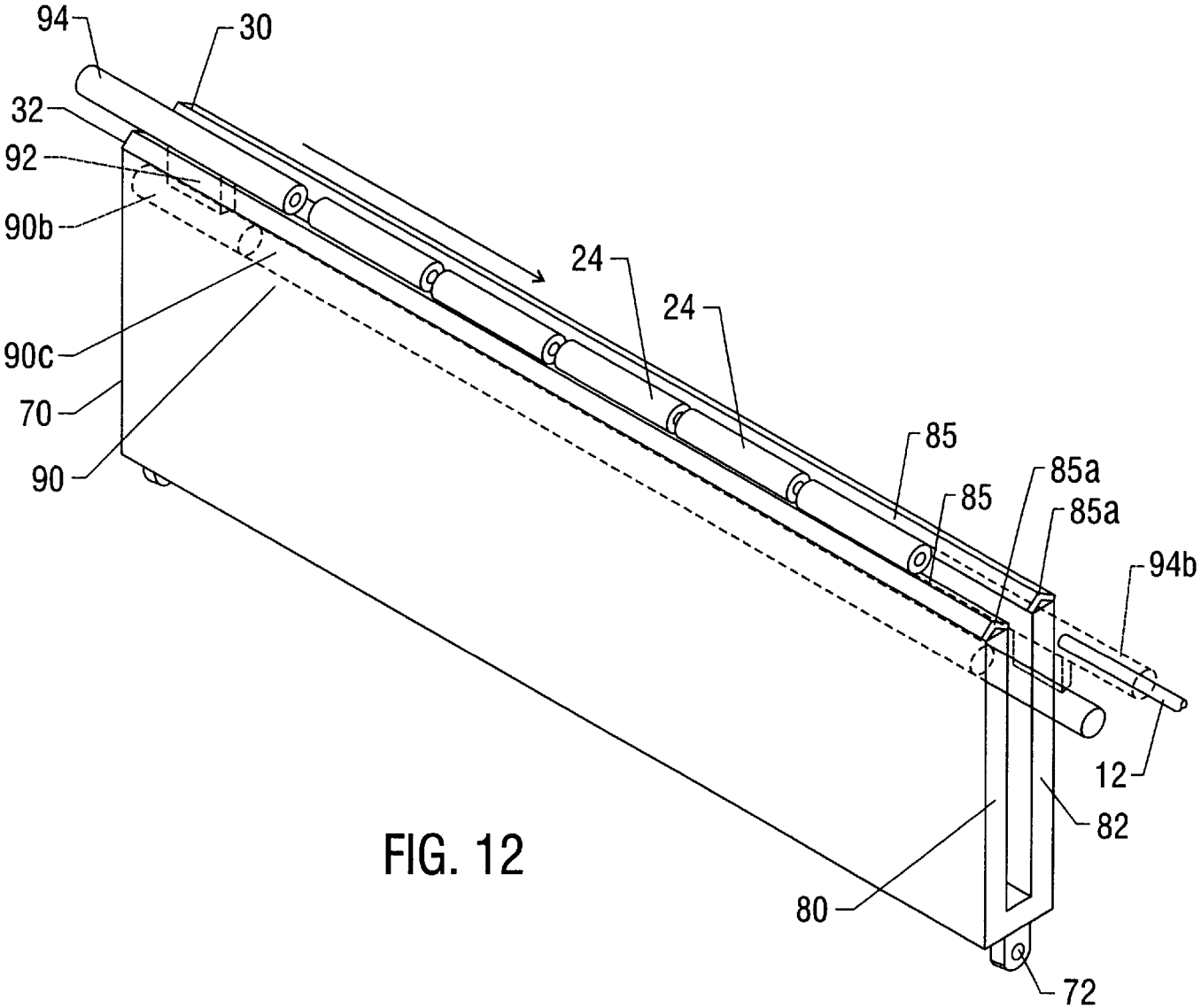
FIG. 12 is a simplified perspective view of a core loader according to one embodiment of the disclosed method and apparatus.

In one core loader/core loading rack embodiment shown in FIG. 12, a core mechanical displacement device that in this case is a core ram 32 is provided which comprises a motorized or otherwise suitably actuated driver 90, which may be attached to a ram head 94 via an optional extension piece 92, placing ram head 94 within core cradle 84. Driver 90 is typically positioned below frame member edges 85 and between longitudinal frame members 80 and 82 as shown. In this embodiment, core loading ram head 94 is configured to travel the length of core cradle 84 in such a way that ram head 94 contacts and pushes or axially moves cores 24 in a longitudinal direction off one end of cradle 84 in a direction as indicated, and onto a winder shaft 12 axially aligned with cradle 84. As used herein, "axially move" is defined to mean the act of causing cores or rolls to be moved in a direction parallel to and/or along their longitudinal axis and in a manner such that the cores or rolls are either moved from a core rack onto the end of a winder shaft or moved off the end of a winder shaft onto a roll conveyor.

Figure 11:
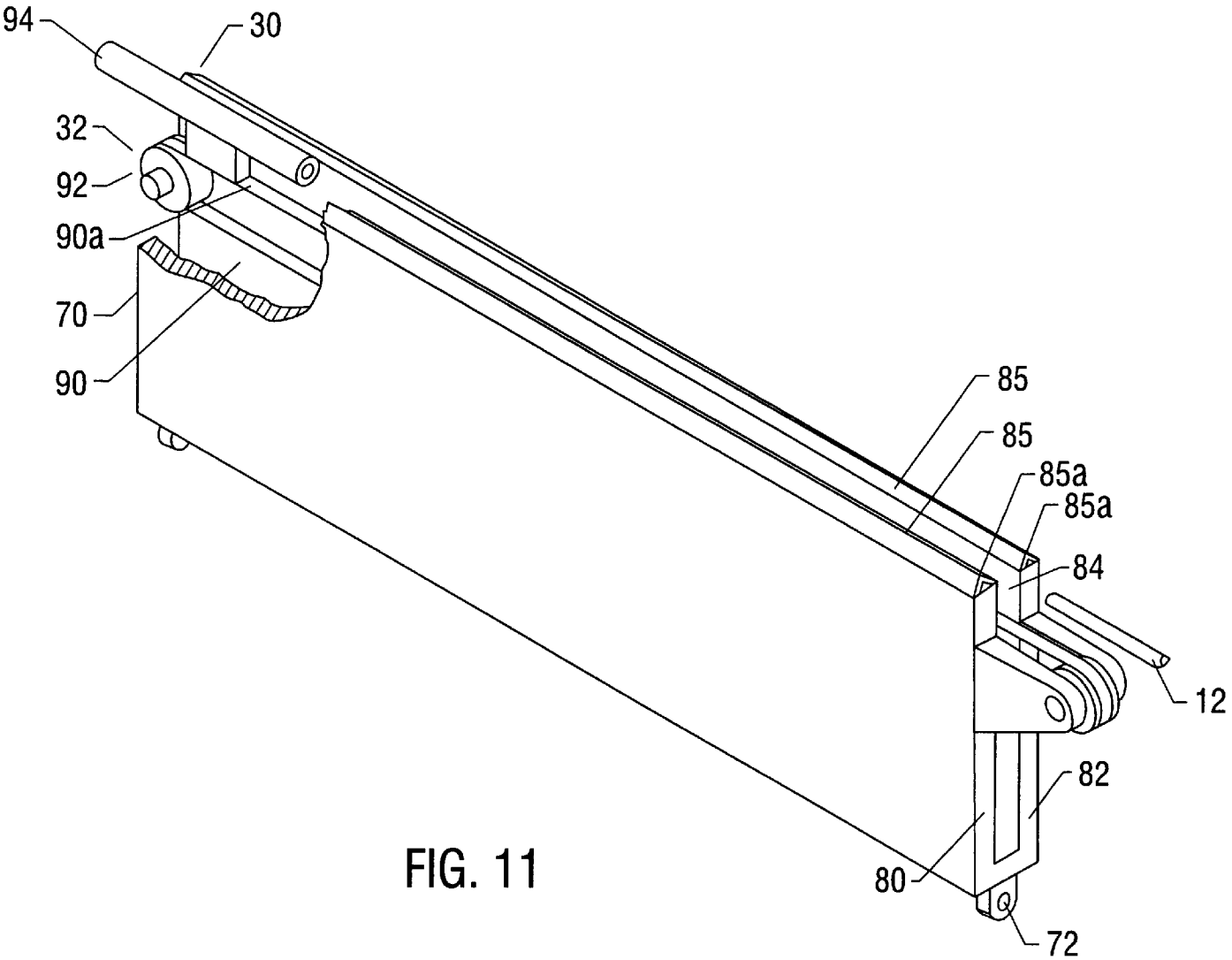
FIG. 11 is a simplified perspective view of a core loader according to one embodiment of the disclosed method and apparatus.

In the embodiment of FIG. 11, core loading ram head 94 is typically adapted to be driven back and forth within cradle 84 by a ram driver, which in this case is a motorized belt or chain 90*a* as shown. Ram head 94 is typically constructed of 3 inch internal diameter PVC pipe that is typically from about 8 to 10 inches long. In this embodiment, ram head 94 is typically coupled to ram driver belt or chain 90*a* and ram head 94 is oriented above cradle 84 and in suitable position to contact and propel or move cores 24 onto a winder shaft 12.

In an alternate and more typical embodiment of core loader shown in FIG. 12, core loading ram 32 includes a ram head 94 (as previously described) coupled to a ram driver that comprises a double acting rodless air cylinder 90*c*. As shown in FIG. 12, rodless air cylinder 90*c* is coupled and configured so that piston 90*b* travels in a longitudinally adjacent path back and forth along the length of core cradle 84. In this embodiment, ram head 94 is typically mounted to piston 90*b* so that movement of piston 90*b* back and forth along cylinder 90*c* causes ram head 94 to contact and push or axially move cores 24 in a longitudinal direction off one end of cradle 84 in a direction as indicated, and onto a winder shaft 12 axially aligned with cradle 84. Movement of piston 90*b* in the opposite direction returns ram head 94 to its original position so that additional cores may be received by core loading rack 30 and the loading process repeated. As used herein, "axially move" is defined to mean the act of causing cores or empty rolls to be moved in a direction parallel to and/or along their longitudinal axis and in a manner such that the cores or wound rolls are either moved from a core rack onto the end of a winder shaft or moved off the end of a winder shaft onto a roll conveyor. In this embodiment, any type and/or size of pneumatic or hydraulic rodless air cylinder suitable for moving a ram head 94 back and forth along cradle 84 may be employed. For example, a rodless air cylinder of about 118 inches in length and having a bore of about 1-¼" is typically used. Such a rodless air cylinder is available, for example, from Numatics of Salina, Kans. However, other diameters, lengths, and/or manufacture of air cylinders may also be employed. Although ram head 94, is typically propelled by a driver 90 that is a rodless air cylinder or motorized belt or chain, other propulsion means suitable for propelling ram head 94 along the length of cradle 84 may be employed including, but not limited to, a trolley and rail arrangement and a rack and pinion arrangement. In addition, core mechanical displacement devices may also employ suitable devices or means other than a ram head for contacting and displacing cores onto a winder shaft.

In both the above embodiments of core ram 32, ram head 94 is typically at least partially hollow so as to fit over, or overtravel, the end of shaft 12 (typically by about 8 to 10 inches) when ram head 94 has traveled to the end of core cradle 84 located adjacent the end of shaft 12, at which point cores 24 have been pushed onto shaft 12 as shown in FIG. 12 (this position designated by 94*b*). Rain head overtravel is made possible by positioning and configuration of driver 90 in relation to ram head 94 and the end of shaft 12.

Although ram head 94 is typically constructed of PVC pipe as shown, other ram head shapes and designs suitable for contacting and propelling cores along cradle 84 may be employed, such as pipe or non-circular shaped segments of varying lengths and diameters, and/or constructed of other materials including, but not limited to, steel, fiberglass, and plastics other than PVC. In any case, a ram head typically has an open or hollow front space for receiving the end of a winder shaft when the ram head has been fully displaced toward the shaft in order to push cores onto the shaft.

Although one embodiment of a core loading rack 30 is illustrated, it will be understood with benefit of this disclosure that other configurations are possible. Any form of longitudinal track, tray, trough, or other structure suitable for receiving cores 24 from carriage 28 may be used instead of a cradle 84. For example, a cylindrical, half cylindrical, or solid bottom trough of sufficient dimensions for receiving cores may be employed with, for example, a ram device having a ram guide that protrudes through and operates along a longitudinal slot disposed in the bottom or side of the trough. Alternatively, in any core loading rack embodiment, a ram head may be coupled to move along a track, rail or other conveyance device known in the art that is mounted above or otherwise adjacent a cradle, trough or other longitudinal core receiving structure.

Figure 8:
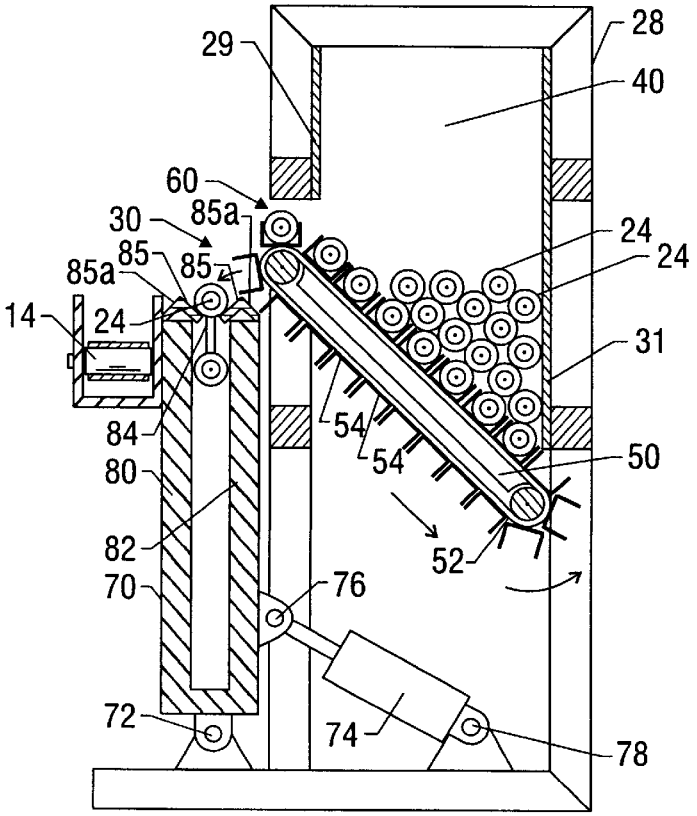
FIG. 8 is a simplified cross sectional view of a core carriage, core rack, roll conveyor and movable frame according to one embodiment of the disclosed method and apparatus.

Core loading rack 30 is typically mounted or disposed adjacent and longitudinally parallel to roll conveyor 14 on a frame, more typically the upper end of a movable frame 70 that is configured to pivot about its lower end at a frame pivot point 72, as shown in side view in FIGS. 8 and 9. Frame pivot point 72 is typically located at a point of attachment or connection to carriage 28 by bolt, pin, bushing, pillar block bearing and shaft, or other suitable pivotable attachment or mounting device know in the art. However, it will be understood with benefit of this disclosure that a frame pivot point may be located or positioned in a number of ways, for example, such that a movable frame is mounted or disposed adjacent to, but separately from carriage 28 as well. Furthermore, it will be understood that a movable frame may be otherwise adapted or configured to move so that a core loading rack and roll conveyor may be alternately placed in axial alignment with a winder shaft. For example, a movable frame may be adapted to move in a non-pivoting motion, such as by sliding back and forth on a track or rod in a reciprocating motion similar to that of the embodiments shown in FIGS. 21–30. In another example embodiment of the disclosed method and apparatus, a frame may be suspended from a pivot point located above a roll conveyor and core rack. Additionally, any other means suitable for moving a movable frame known to those of skill in the art may also be employed. Furthermore, a roll conveyor and/or core rack may be employed individually (i.e., either one may be employed without the other), and/or may be adapted to be moveable without a frame. For example, a roll conveyor and core rack may be supported individually on separate frames or using a frameless configuration.

Figure 13:
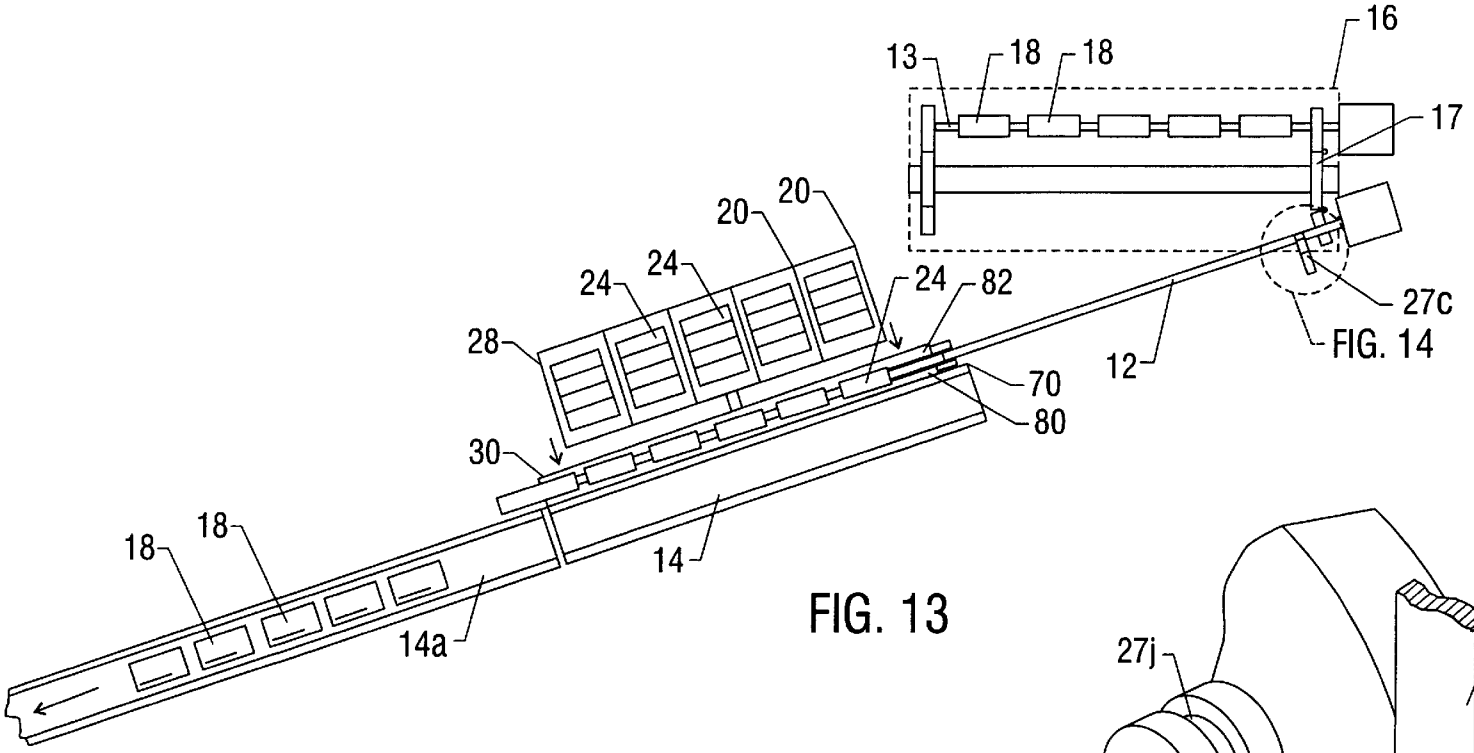
FIG. 13 is a simplified overhead view showing an arrangement of a core carriage, core rack, roll conveyor, movable frame and winder according to one embodiment of the disclosed method and apparatus.
Figure 19:
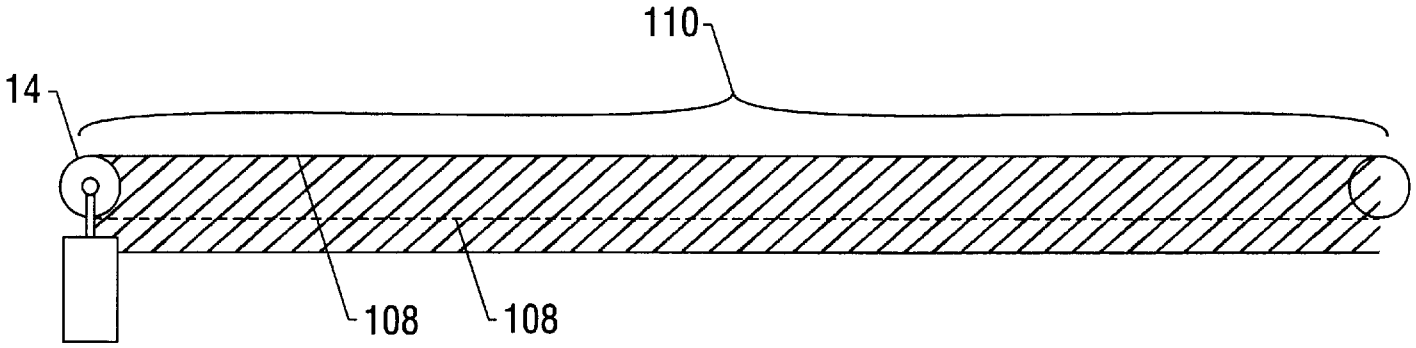
FIG. 19 is a simplified side view of a roll conveyor according to one embodiment of the disclosed method and apparatus.
Figure 20:
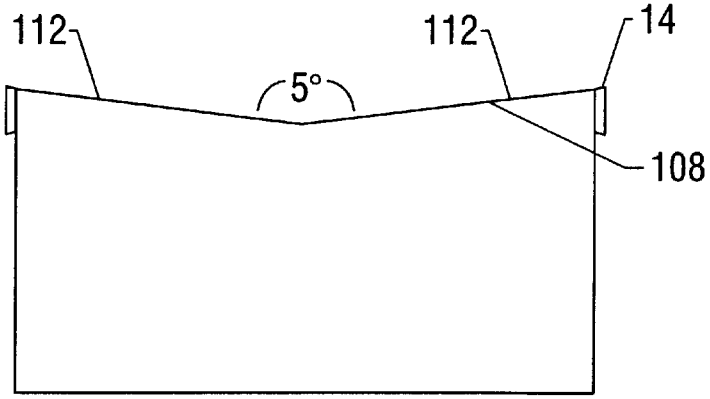
FIG. 20 is a simplified end view of a roll conveyor according to one embodiment of the disclosed method and apparatus.

As shown, roll conveyor 14 is typically a conveyor belt of suitable dimensions for receiving and mechanically conveying wound rolls from winder shaft 12 as they are removed from shaft 12. Although any suitable sizes, dimensioned, and/or type of conveying device may be employed, roll conveyor 14 is typically a motorized conveyor having a belt 108 of about ⅛ inches thick to form a conveying surface 110 of about 174 inches long and about 9 inches wide as shown in side view in FIG. 19 and in end view in FIG. 20. In a typical embodiment, belt 108 has inclined surfaces a 112 for accepting and centering rolls 18. Surfaces 112 are typically angled downward from the outside longitudinal edges of belt 108 to meet at the longitudinal center of belt 108 as shown in FIG. 20. Typically, surface edges 112 are angled downward at an angle of about 5 degrees from the vertical, although angles greater or lesser than 5 degrees, or flat conveyor belt surfaces having no angles may also be employed. Roll conveyor 14 is typically of a minimum length necessary to convey and remove a set of wound rolls 18 away from a winder shaft 12 in the direction indicated in FIG. 2 in such a way that sufficient space is created for roll conveyor 14 to accept another set of wound rolls 18 removed from winder shaft 13. A proximity sensor may optionally be employed to activate conveyor 14 to convey rolls away when rolls are present or being unloaded from a winder shaft, or alternatively may be employed to activate conveyor 14 until a set of rolls removed from a winder shaft has been conveyed away to the end of the conveyor. In either case, any proximity switch known in the art may be employed such as, for example, a photoelectric sensor employed at the end of conveyor 14 that acts to stop the conveyor action when rolls are sensed at the end of the conveyor and that acts to reactivate conveyor action when rolls are removed, for example, by hand. As shown in FIG. 1, conveyor 14 is typically of similar length, and mounted parallel to, core rack 30. As illustrated in FIG. 13, a roll conveyor may exist in a variety of embodiments, including a multi-belt conveyor in which rolls are conveyed away from a winder shaft by more than one conveyor belt (in this case via second conveyor belt 14*a*), or in the alternative, by a single longer conveyor belt.

Figure 29:
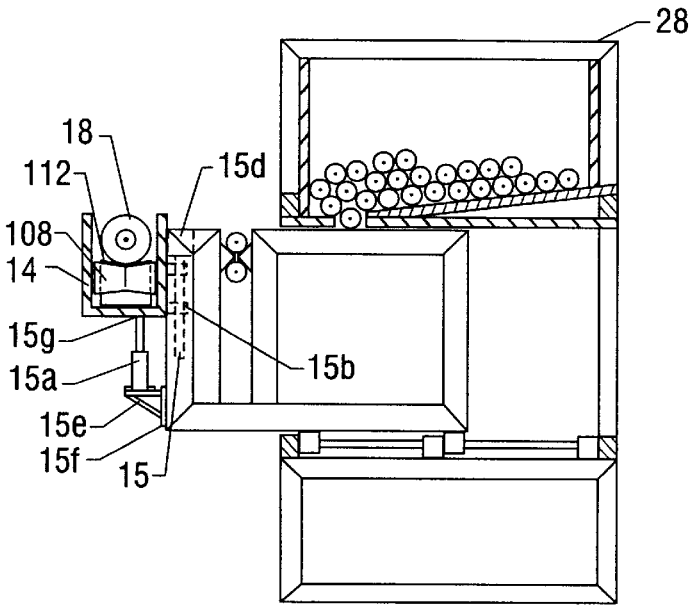
FIG. 29 is a simplified cross sectional view of a core carriage, core rack, roll conveyor, reciprocating frame and conveyor elevator according to one embodiment of the disclosed method and apparatus, showing the reciprocating frame in extended position.
Figure 30:
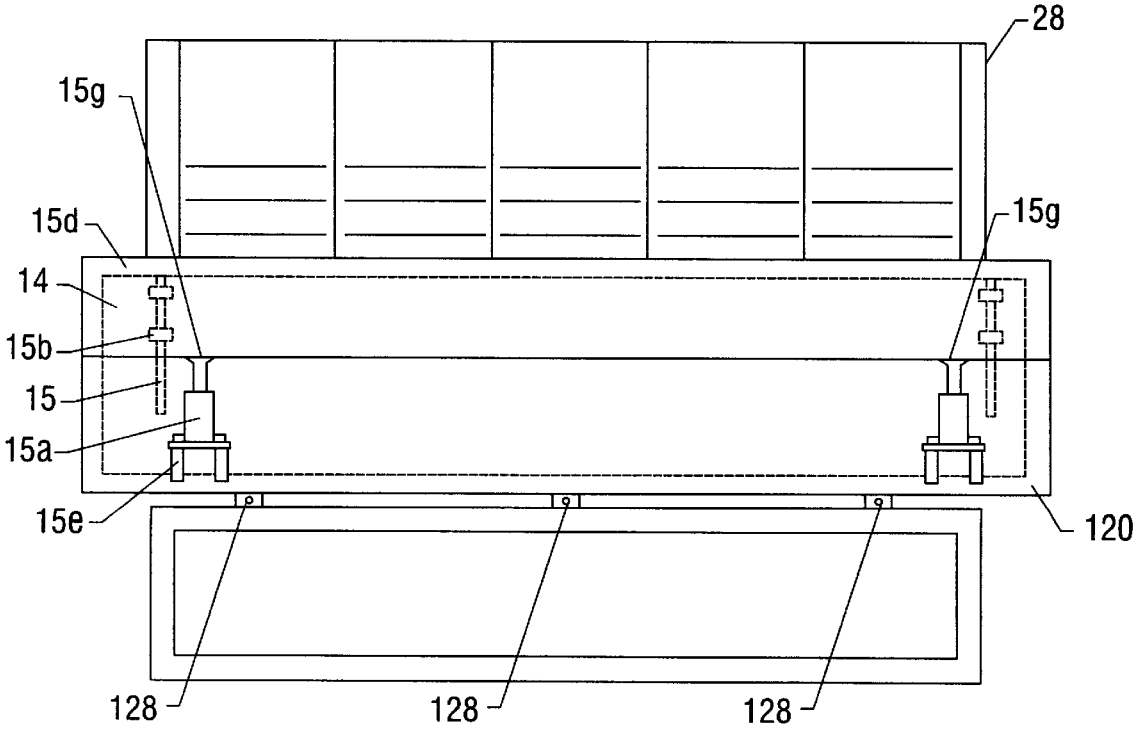
FIG. 30 is a simplified side view showing an arrangement of a core carriage, core rack, roll conveyor, reciprocating frame, and conveyor elevator according to one embodiment of the disclosed method and apparatus.

A roll conveyor 14 may be mounted on a frame (such as adjacent core rack 30 of FIG. 1) or on another type of support in a fixed or adjustable manner. For example, a roll conveyor 14 may be permanently or fixedly mounted in a single position such that it is in proper alignment with a winder shaft 12, in order to receive wound rolls 18 of a particular diameter (or range of diameters) displaced from the end of a shaft 12 which is positioned at a particular height or distance from the floor or base of winder 16. In the alternative, a roll conveyor 14 may be adjustably mounted on a frame or other suitable support in order to accommodate a variety of different roll diameters and/or winder shaft heights. For example, as shown in FIGS. 29 and 30, roll conveyor 14 may be adjustably mounted in movable relationship with a frame (in this case a movable reciprocating frame 120) using a conveyor elevator configuration. It will be understood with benefit of this disclosure that a conveyor elevator mechanism may also be employed with other types of movable frames including, but not limited to, movable pivoting frames.

A conveyor elevator configuration may be any suitable mechanism for raising and lowering ends of conveyor 14, together or separately. In this way, opposing ends of conveyor 14 may be moved upward or downward so that surfaces 112 of belt 108 are in proper position relative to the end of shaft 12 to receive wound rolls 18 of a desired diameter. Typically, a conveyor elevator configuration includes rod 15 and linear bearings 15*b* (such as 1" linear rod and bearings) to movably attach each end of conveyor 14 to a frame as illustrated in FIGS. 29 and 30 (for simplicity, shown here without actuator 133 or attachment points 76*a* and 78*a*). In this regard, rods 15 may be attached to or suspended from reciprocating frame members 15*d* (typically about 6 inches from each end of reciprocating frame 120) and bearings 15*b* attached to conveyor 14 as shown, or in any other suitable manner, such as by attachment to separate mounting plates, etc. Elevator actuators, typically air cylinders 15*a* (such as 6 inch stroke air cylinders), are typically employed near each end of conveyor 14 for moving each end of conveyor 14 up or down in relation to a frame. In this regard, air cylinders 15*a* may be configured to actuate simultaneously to raise or lower both ends of conveyor 14, or configured to actuate separately to raise or lower one end of conveyor 14 in relation to the other end. Air cylinders 15*a* are typically supported and attached to reciprocating frame 120 by means of platforms 15*e*, although any other manner and/or materials known in the art suitable for attaching and supporting elevator actuators to a frame may be employed. The use of multiple and independent acting acturators may be desirable, for example, when it is desired that conveyor 14 be placed at an angle to the horizontal. Air cylinders 15*a* are typically connected to conveyor 14 using a flexible coupling 15*g*, such as a clevis or other suitable flexible coupling known in the art. Similar flexible couplings may be provided at the connection point between air cylinders 15*a* and platforms 15*e* if so desired. Although an embodiment employing two air cylinders 15*a* is pictured, it will be understood with benefit of this disclosure that any other type and/or number of elevator actuators suitable for raising or lowering a conveyor known to those of skill in the art may be employed including, but not limited to, one or more electric or pneumatic actuators. Furthermore, although two linear bearing mechanisms are illustrated, it will be understood that any other type and/or number of adjustable mounting methods suitable for movably mounting a conveyor to a frame or other support known to those of skill in the art may be employed including, but not limited to, one or more of the following types of assemblies: wheel or caster assemblies which move in relationship to a track, pivot arms attached between a frame and conveyor, rods mounted to a frame and extending through bushings in a conveyor assembly, etc.

In still another embodiment, an elevator may be capable of automatically raising and lowering a conveyor to preset positions. In still other embodiments, an elevator may operate manually rather than automatically, such as by means of a hand driven geared mechanism, or by a simple slot and bolt combination allowing hand adjustment of each end of conveyor in a manner similar to adjusting the position of an alternator when tightening an automobile fan belt.

Wound rolls 18 may be removed from conveyor 14 by hand or automated means known in the art. In addition to the embodiment shown, conveyor 14 may be of sufficient length to convey wound rolls further away for further processing or packaging, or may be configured to deliver wound rolls 18 to other conveyance devices known in the art, such that wound rolls 18 are conveyed away for further processing or packaging. Furthermore, although a belt conveyor is typically employed in the practice of the disclosed method and apparatus, it will be understood with benefit of the present disclosure that a roll conveyor may be any suitable device for conveying wound rolls 18 away from a winder shaft including, but not limited to, a chute angled downward and away from the end of a winder shaft. In the alternative, benefits of the disclosed method and apparatus may be obtained without a roll conveyor, in which case wound rolls may be mechanically loaded onto a winder shaft and removed from a winder shaft by hand. In a further alternative, benefits may also be obtained in embodiments lacking a core loader but using a roll conveyor to mechanically remove or unload wound rolls from a winder shaft.

Figure 2:
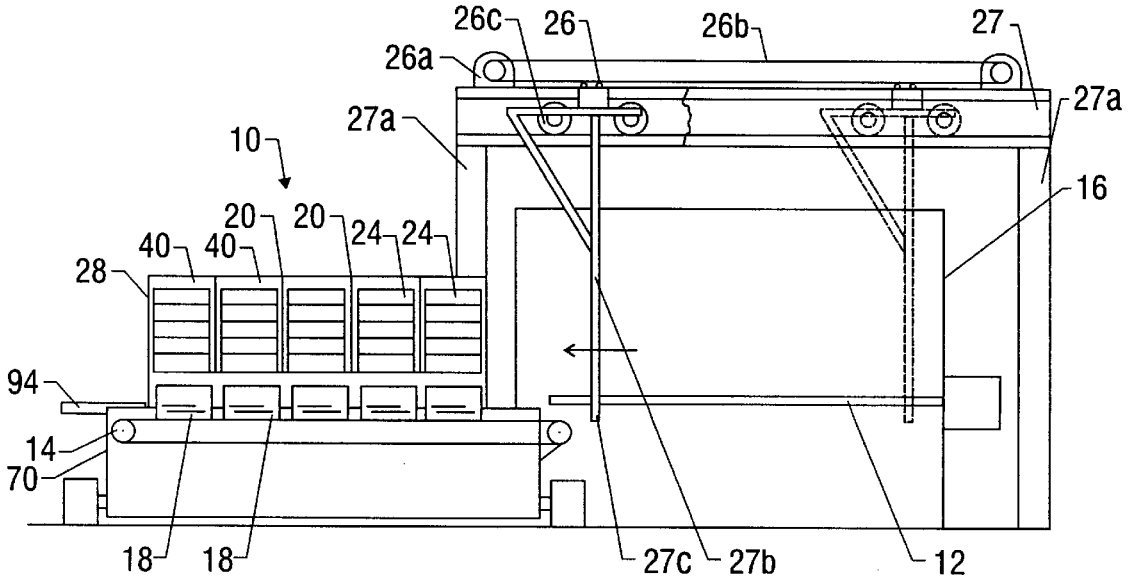
FIG. 2 is a simplified side view showing an arrangement of a core carriage, core rack, roll conveyor, movable frame, overhead trolley and winder according to one embodiment of the disclosed method and apparatus.
Figure 3:
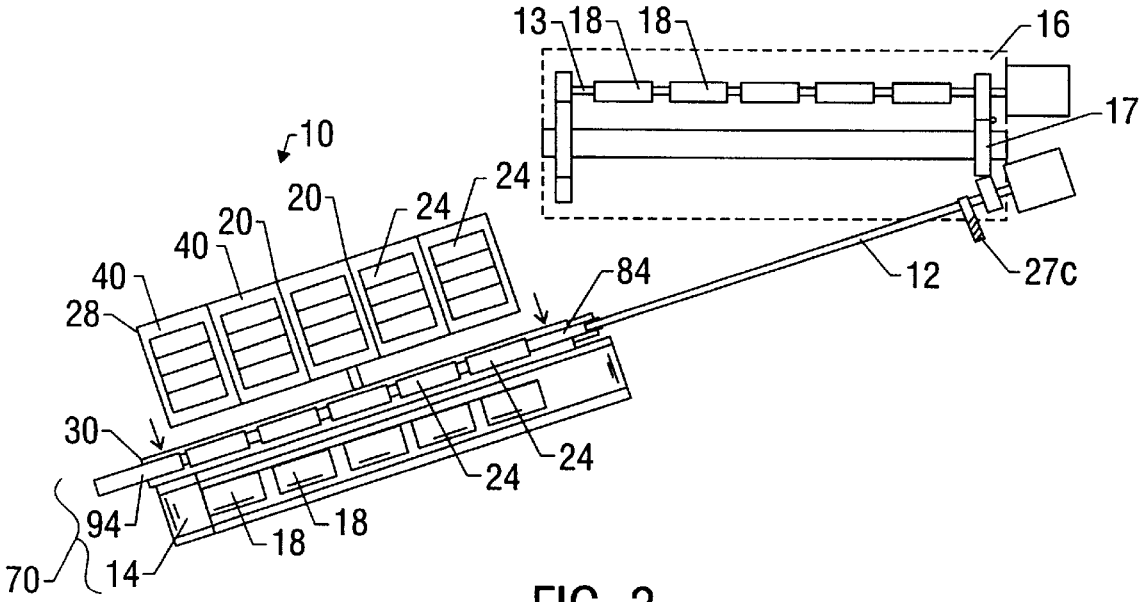
FIG. 3 is a simplified overhead view showing an arrangement of a core carriage, core rack, roll conveyor, movable frame and winder according to one embodiment of the disclosed method and apparatus.
Figure 4:
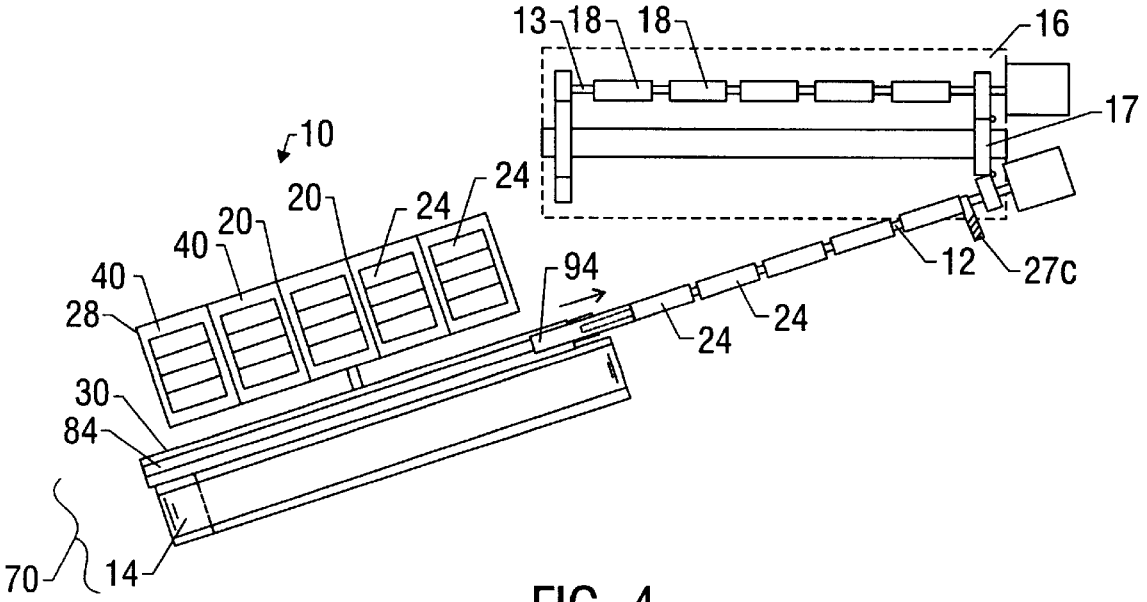
FIG. 4 is a simplified overhead view showing an arrangement of a core carriage, core rack, roll conveyor, movable frame and winder according to one embodiment of the disclosed method and apparatus.

As shown in FIGS. 8 and 9, one or more two-way acting air cylinders 74 are typically provided as pivot actuators for alternatively pivoting frame 70 between a first position as shown in FIG. 8, and a second position as shown in FIG. 9. As shown in FIGS. 1, 2, and 8, in the first position of movable pivoting frame 70, core loading rack 30 is positioned adjacent carriage opening 60 for receiving cores from carriage 28. In this same position of movable pivoting frame 70, core conveyor 14 is positioned in axial alignment with winder shaft 12 so as to receive wound rolls 18 from winder shaft 12 and to convey rolls 18 away. As shown in FIGS. 3 and 4, in the second position core loading rack 30 is positioned in axial alignment with winder shaft 12 for loading cores onto winder shaft 12 As shown in FIGS. 8 and 9, air cylinder 74 is typically pivotably mounted or coupled to carriage 28 at one or more attachment points 78 and to movable pivoting frame 70 at one or more attachment points 76.

Although FIGS. 10 and 16 illustrate one possible position for a single attachment point 78, it will be understood with benefit of this disclosure that one or more attachment points 78 may be positioned in any suitable location for attaching movable pivoting frame 70 to carriage 28 via an air cylinder 74 or other type/s of actuator. Furthermore, a pivot actuator 74 may be mounted or coupled in any other manner known in the art suitable for pivoting frame 70. In the present embodiment, a pivot activator 74 is typically an air cylinder such as is available from Numatics of Salina, Kans., although other types of air cylinders or pneumatic actuators may also be used. Furthermore although one or more pneumatic actuators are typically employed as a pivot actuator, any type of actuator or mixture of actuator types suitable for pivoting frame 70 between first and second positions may also be employed including, but not limited to, hydraulic actuators, electric actuators, and the like. Although one possible position of a pivot actuator is illustrated in the figures, pivot actuators may be employed in any other position/s suitable for pivoting a frame 70. Furthermore, a movable pivoting frame 70 may be adapted to be pivoted by hand using methods known in the art.

Figure 21:
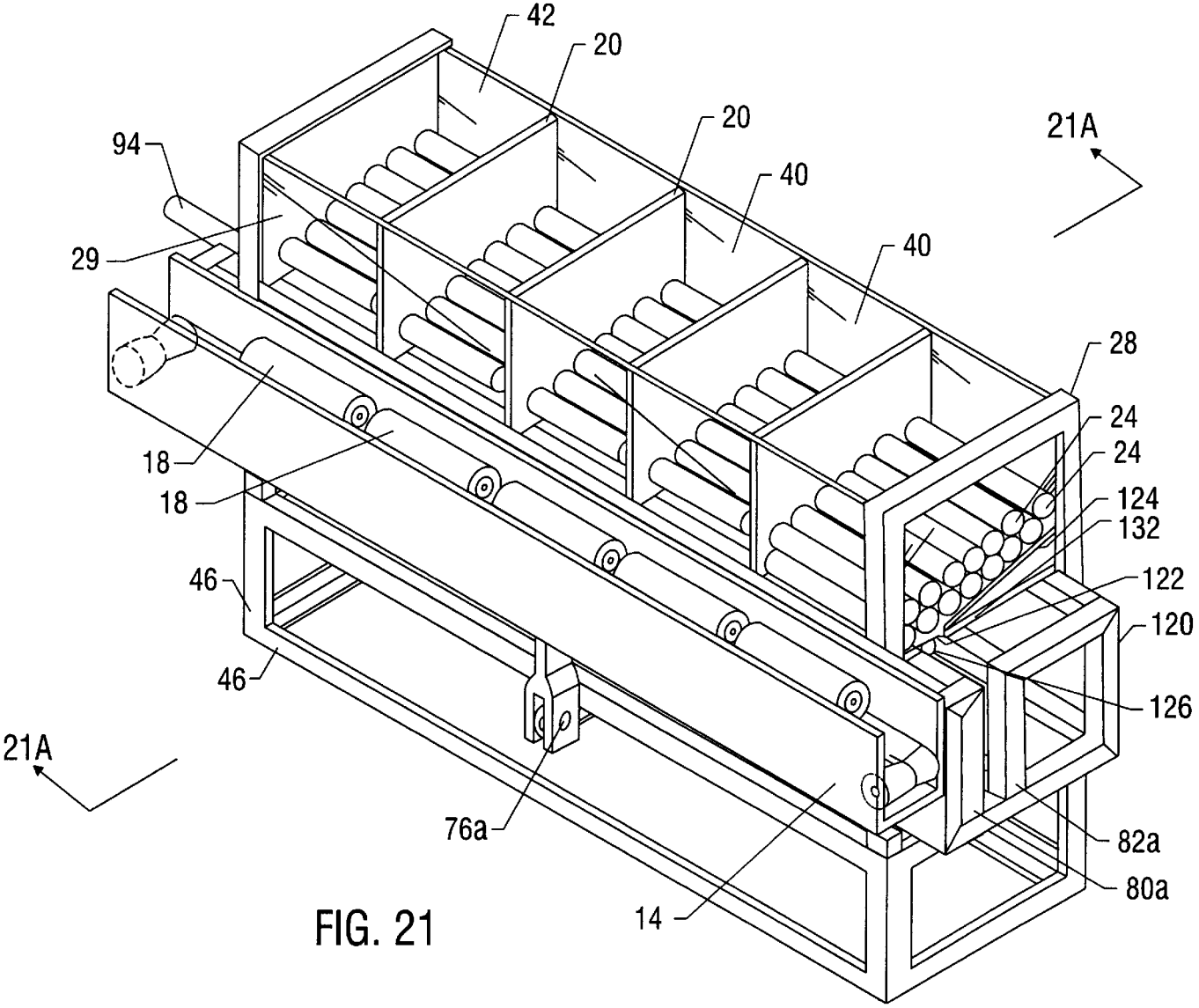
FIG. 21 is a simplified perspective view of a core carriage, core rack, roll conveyor and reciprocating frame according to one embodiment of the disclosed method and apparatus, showing the reciprocating frame in retracted position.
Figure 22:
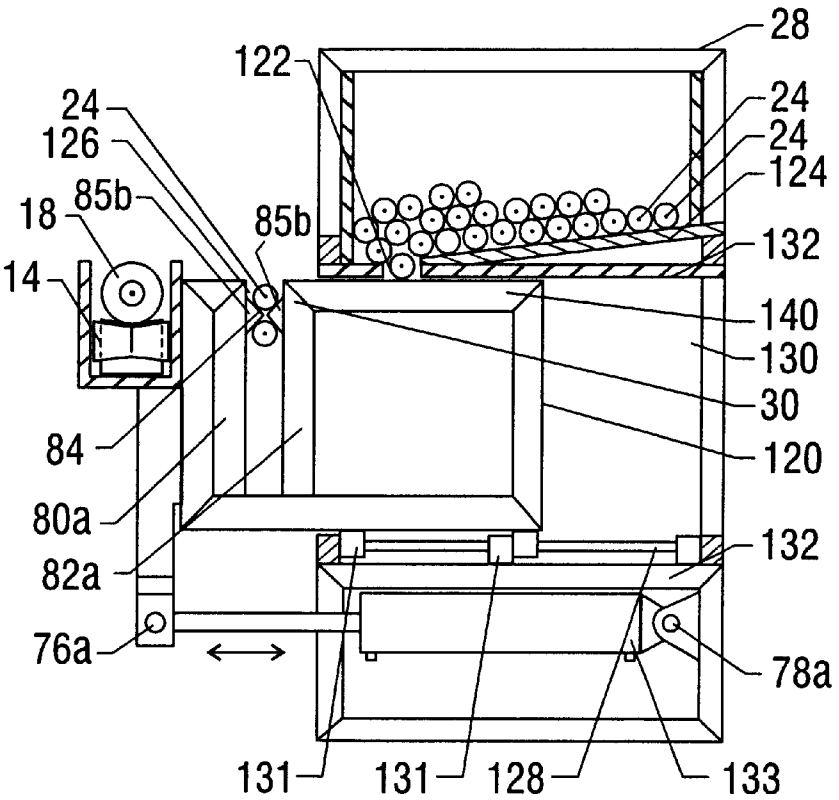
FIG. 22 is a simplified cross sectional view of a core carriage, core rack, roll conveyor and reciprocating frame according to one embodiment of the disclosed method and apparatus, showing the reciprocating frame in extended position.
Figure 21A:
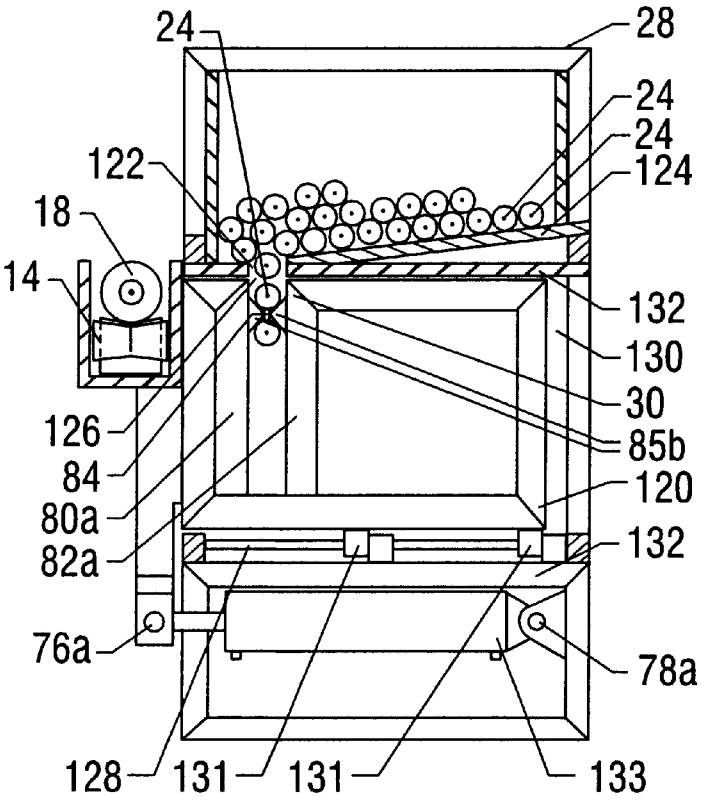
FIG. 21A is a simplified cross sectional view of a core carriage, core rack, roll conveyor and reciprocating frame according to one embodiment of the disclosed method and apparatus, showing the reciprocating frame in retracted position.

In one alternative embodiment shown in FIGS. 21–30, a movable reciprocating frame 120 may be provided instead of movable pivoting frame 70. Reciprocating frame 120 is typically configured to be capable of moving back and forth within carriage 28 in a reciprocating manner between an inward or first position as shown in FIGS. 21 and 21A, and an outward or second position as shown in FIG. 22. By "reciprocating" it is meant that a movable frame is capable of moving back and forth so as to be alternately positioned in relation to a carriage 28 as described above. Typically, the back and forth motion or path of a reciprocating frame is in a direction substantially perpendicular to the linear axis of frame 120, although this is not necessary as long as a movable frame is alternately positioned in relationship to carriage 28 as described above.

Reciprocating frame 120 is typically constructed of 1-½" square steel tubing, but may be constructed of other suitable frame material as mentioned elsewhere herein. Reciprocating frame 120 may be a bare frame or may be a frame covered with sheet metal or other facing material, such as for supporting platforms 15*e* as shown in FIG. 30. Platforms 15*e* may also be supported, for example, using mounting plates 15*f* attached to bare frame members as shown in FIG. 29. Alternatively, a platform 15*e* may be directly or indirectly attached to a bare frame member using any type of support or other method known to those of skill in the art. Typically, reciprocating frame 120 includes an internal core loader/core rack 30 and attached roll conveyor 14 having longitudinal axes disposed in adjacent parallel relationship to each other as shown. In this regard, a core loader and/or roll conveyor may be of any suitable configuration and operation, including any of those embodiments and configurations mentioned elsewhere herein, including those employing a conveyor elevator configuration. As shown in FIGS. 23–28, core rack 30 and roll conveyor 14 are typically configured with reciprocating frame 120 so that roll conveyor 14 is in axial alignment with a winder shaft when frame 120 is positioned in its inward or first position for unloading wound rolls, and so that core rack 30 is in axial alignment with a winder shaft when frame 120 is positioned in its outward or second position for loading empty cores.

As shown in FIGS. 21A and 22, this embodiment typically employs a gravity feed core feeder configuration. Core rack 30 includes a core recess 126 for receiving empty cores 24 by gravity feed from core bins 40 through core opening 122 which is defined in core bin bottom 124. In this regard, core recess 126 is typically dimensioned to be deep enough to accept one core from each bin 40 when reciprocating frame 120 is in its inward position and core recess 126 is aligned with core opening 122, as shown in FIGS. 21A. In the illustrated embodiment, top 140 of reciprocating frame 120 serves to obstruct core opening 122 when reciprocating frame 120 moves forward toward its outward position, as shown in FIG. 22, thus only allowing cores 24 to dispense when reciprocating frame 120 is in its inward position and core recess 126 is aligned with core opening 122. In this regard, top 140 is typically partially or completely covered with an amount of material sufficient to obstruct core opening 122 in a manner described above. Typically, top 140 is partially covered with, for example, ⅛" steel plate. As shown in FIGS. 21A and 22, core bin bottom 124 is typically inclined toward core opening 122 at an angle as shown. However core bin bottom 124 may be inclined at other angles or may be flat, with no inclination. Speed and simplicity are among the advantages offered by the reciprocating frame embodiments of FIGS. 21–30. Because gravity feed is employed, no separate mechanical feeder mechanism (such as a mechanical core conveyor) is required, thus reducing the number of working parts and simplifying the system. Because cores 24 are automatically gravity fed into core rack 30 from core bins 40 when reciprocating frame 120 is moved into its inward position, empty cores 24 are immediately ready for further loading and no separate core feeding step or time for a core feeder mechanism to operate is required. This further increases the potential speed at which winder shaft loading and unloading may be carried out.

Although a gravity feed core opening is typically employed with a movable reciprocating frame, it will be understood with benefit of this disclosure that other core feeder embodiments may also be used with a reciprocating frame including, but not limited to, mechanical core conveyors and other types of core feeder configurations described elsewhere herein. Furthermore, it will be understood with benefit of this disclosure that any suitable type of movable frame may be employed with a gravity feed core opening including any of those embodiments of movable frames described elsewhere herein. For example, a gravity feed core opening may be used with a movable pivoting frame instead of a movable reciprocating frame, but otherwise in a manner similar to that described herein for a movable reciprocating frame.

Typically, reciprocating frame 120 is disposed within a carriage interior space 130 defined within carriage 28 by transverse carriage frame members 132, although other configurations of carriage frame members and reciprocating frame 120 are possible. In such reciprocating frame embodiments, carriage 28 is typically of similar configuration as mentioned elsewhere herein, being an enclosed container having one or more bins 40 separated by dividers 20 as previously described. However, because reciprocating frame 120 is received within carriage 28, bins 40 typically extend forward to a position closer to pivotable shaft 12 in its angular outward unloading position, creating bins that are typically greater in depth than those embodiments employing a pivoting frame, and in which the forward extent of carriage bins is typically limited by the placement of the pivoting frame. For example, a typical reciprocating frame embodiment employs a carriage 28 having bins 40 that are typically about three feet in depth as shown in FIGS. 21A and 22, although it will be understood that the dimensions shown in the figures are merely exemplary In comparison, a typical pivoting frame embodiment employs a carriage 28 having bins 40 that are limited in forward extension by movable pivoting frame 70 and that are two feet in depth as shown in FIGS. 8 and 9. Advantageously then, this embodiment typically allows increased bin capacity for storing a greater number of empty cores.

Although one embodiment of reciprocating frame 120 and carriage 28 is illustrated and described above, it will be understood that a reciprocating frame configuration may be employed in other ways including, but not limited to, in an operating position exterior to a core carriage 28 and core feeder similar to that described for a movable pivoting frame elsewhere herein. In addition, a movable pivoting frame may be disposed in an operating position within a carriage interior space 130 adjacent to a core opening as similar to that described for a movable reciprocating frame elsewhere herein.

Reciprocating frame 120 is typically configured to move in relationship with carriage 28 using a rod 128 and linear bearings 131 disposed at the base of frame 120 as shown in FIGS. 21A and 22. Such a rod and bearing mechanism is typically in place at each end of reciprocating frame 120 (such as at a position about six inches from each end of frame 120), and more typically also includes a center mechanism as shown in FIG. 30, although fewer or additional mechanisms may be distributed along the length of reciprocating frame 120 and/or interior space 130 as necessary to movably support reciprocating frame 120. However, it will be understood with benefit of this disclosure that any other configuration and/or methods known to those of skill in the art and suitable for movably mounting a reciprocating frame within a carriage 28 may be employed. Such methods include, but are not limited to, wheels or casters which move in relationship to a track, pivot arms attached between carriage frame 28 and reciprocating frame 120, rods mounted to carriage frame 28 and extending through bushings in reciprocating frame 120, etc. Furthermore, reciprocating frame 120 may be supported and/or movably attached to carriage frame 28 at its base (as shown in FIGS. 21A and 22), at its top, and/or at any other point therebetween.

As shown in FIGS. 21, 21A, and 22, reciprocating frame 120) is typically alternately positioned between its inward and outward positions using one or more reciprocating actuators 133 mounted between carriage frame 28 and reciprocating frame 120. Typically, a reciprocating actuator 133 is a pneumatic actuator as shown, such as an air cylinder available from Numatics of Salina, Kans. which mounted or coupled to carriage 28 at one or more attachment points 78*a* and to movable reciprocating frame 120 at one or more attachment points 76*a*. Although FIGS. 21, 21A, and 22 illustrate possible positions for a attachment points 76*a* and 78*a*, it will be understood with benefit of this disclosure that one or more attachment points 76*a* and one or more attachment points 78*a* may be positioned in any suitable location for attaching movable reciprocating frame 120 to carriage 28 via an air cylinder or other type/s of actuator 133. In this regard, will be understood with benefit of this disclosure that one or pneumatic actuators and/or other types of suitable actuators may be positioned in any other suitable location/s for attaching and/or moving movable reciprocating frame 120 to carriage 28. Other suitable actuator or drivers that may be employed include, but are not limited to, hydraulic actuators, electric actuators, rodless air cylinders, electric servo motors, etc. It will also be understood that a reciprocating actuator 133 may be mounted or coupled in any other manner known in the art suitable for moving reciprocating frame 120. Furthermore, a movable reciprocating frame 120 may be adapted to be moved back and forth by hand using any suitable methods known in the art.

In a typical reciprocating frame embodiment, a core loader includes a core rack 30 and recessed longitudinal core cradle 84 for supporting cores that is formed by adjacent frame members 80*a* and 82*a*. Frame members 80*a* and 82*a* may be constructed of steel or other suitably strong frame material, and typically have edges angled inward at about 45° at the point of contact with cores 24, such as may be formed by segments 85*b* of 2 inch angle iron placed on end (as shown in FIGS. 21A and 22). However, such edges may be of any configuration suitable for forming a cradle 84 or other surface having a longitudinal axis upon which cores 24 may slide or be driven toward a winder shaft 12. A core mechanical displacement device including core ram 32 and ram head 94 as described elsewhere herein is typically provided for axially moving cores off one end of cradle 84 onto a winder shaft 12 as previously described. A roll conveyor 14 is typically mounted or disposed adjacent and longitudinally parallel to core loading rack 30. Although particular embodiments of core mechanical displacement device and roll conveyor are illustrated in FIGS. 21–30, it will be understood with benefit of this disclosure that any other embodiment of these components described herein may also be employed with a movable reciprocating frame.

Figure 7:
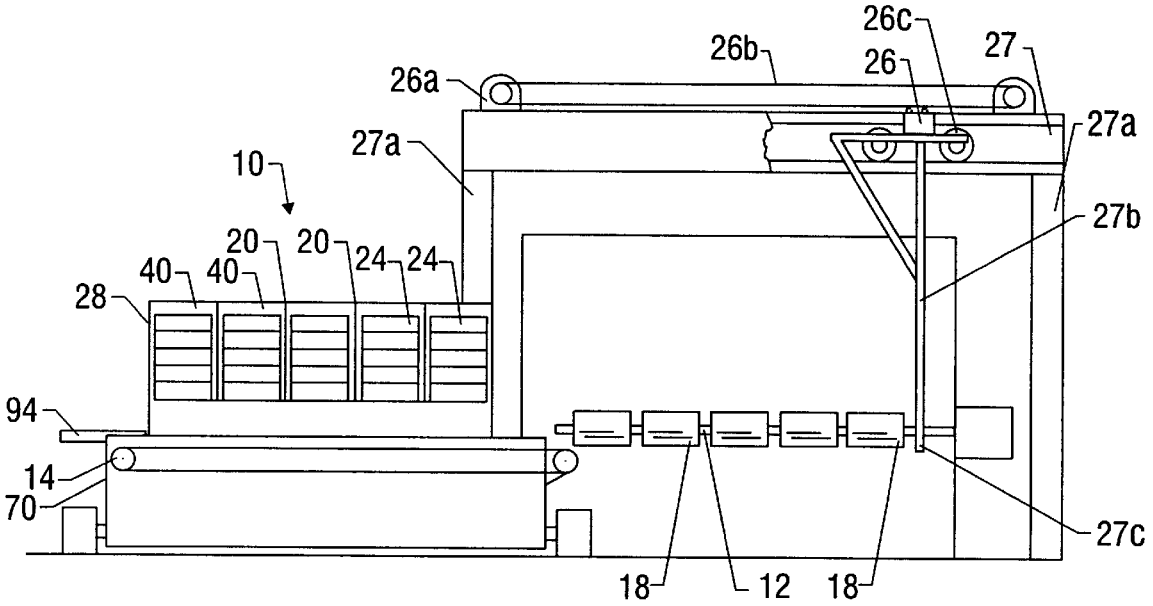
FIG. 7 is a simplified side view showing an arrangement of a core carriage, core rack, roll conveyor, movable frame, overhead trolley and winder according to one embodiment of the disclosed method and apparatus.
Figure 17:
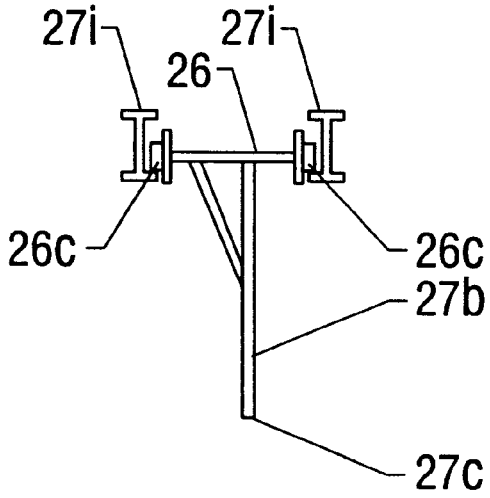
FIG. 17 is a simplified end view of an overhead trolley according to one embodiment of the disclosed method and apparatus.

As shown in side view in FIGS. 2 and 7, a roll remover including a roll mechanical displacement device, typically an overhead trolley 26, may be employed to mechanically remove or unload wound rolls from winder shaft 12 onto roll conveyor 14. An overhead trolley 26 may be employed in this manner with movable pivoting frame embodiments (as pictured in FIGS. 1 and 7), or with other movable frame embodiments, such as the moveable reciprocating frame embodiments of FIGS. 21–30. Overhead trolley 26 is typically a rail type overhead trolley powered by a servo drive motor 26*a* that is attached or coupled to propel trolley 26 back and forth on a trolley rail 27 by means of an endless timing belt 26*b* as shown in further detail in end view in FIG. 17 and in side view in FIGS. 2 and 7. As shown in FIG. 17, rail 27 is typically comprised of two parallel segments of 6 inch steel I-beam 27*i* spaced apart by about 2 feet, and trolley 26 is typically configured with wheels 26*c* which ride on interior I surfaces of the I-beam segments of rail 27. However, it will be understood with benefit of this disclosure that any suitable overhead trolley, trolley drive system, and/or accompanying power supply known in the art may be employed. As shown in the figures, overhead trolley 26 is typically mounted on or coupled to a trolley rail 27 supported by trolley frame members 27*a* in such a way that rail 27 extends from one end of winder 16 to core carriage 28 in a path or direction oriented directly above winder shaft 12 when in its angular outward loading position, as shown in FIGS. 1–4 and 23–26.

Overhead trolley 26 is typically equipped with a roll removal extension 27*b* having a roll removal end 27*c* for contacting wound rolls 18 and pushing them off toward the free end of winding shaft 12 and onto roll conveyor 14 as shown in FIGS. 2, 7, 13, and 24. As shown, trolley 26 is typically configured to operate back and forth along rail 27 so that removal end 27*c* may be alternately positioned at a point between the innermost wound roll 18 and the turret end of pivotable shaft 12 and a point sufficiently close to the free end of shaft 12 to displace rolls 18 from shaft 12. In this way, trolley 26 may be moved back and forth to effect the removal of wound rolls 28. Most typically, frame members 27*a* have points of attachment to the inward or winder side of carriage 28 as shown, although it will be understood with benefit of this disclosure that other attachment schemes and points of attachment may be employed. For example, trolley frame members may be alternately placed in any position relative to winder 16 and/or carriage 28 as long as a trolley removal end 27*c* is positioned to travel along a winder shaft in its angular outward unloading configuration in such a way as to displace rolls from the shaft. In this regard, frame members may be attached or coupled to any point on carriage 28 and winder 16, or may be freestanding near these components. Furthermore, trolley frame members may be positioned at a distance from a carriage and/or winder and support a trolley rail by means of cantilevered arms.

Figure 15:
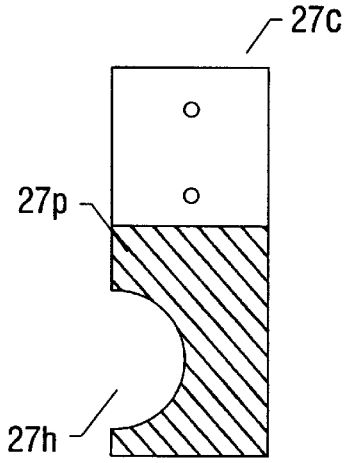
FIG. 15 is a simplified side view of a roll removal end of an overhead trolley extension according to one embodiment of the disclosed method and apparatus.

FIG. 15 shows one embodiment of the roll removal end 27*c* of roll removal extension 27*b*. In this embodiment, removal end 27*c* is typically configured with a recess 27*h* for receiving a winder shaft 12 as end 27*c* is propelled or moved back and forth along shaft 12. Typically, areas of end 27*c* which contact rolls 18 are coated with rubber, hard rubber or other suitable cushioning or shock-absorbing material 27*p* for contacting rolls 18, although such a coating is not necessary. In this regard, end 27*c* may be fully or partially coated with such cushioning or shock-absorbing material. It will be understood with benefit of this disclosure that any other configuration of roll removal end suitable for contacting wound rolls is possible including, but not limited to, roll removal ends having differently shaped recesses, having no recesses, and/or which are merely the terminal end of a roll removal extension 27*b* having no other modification.

Figure 18:
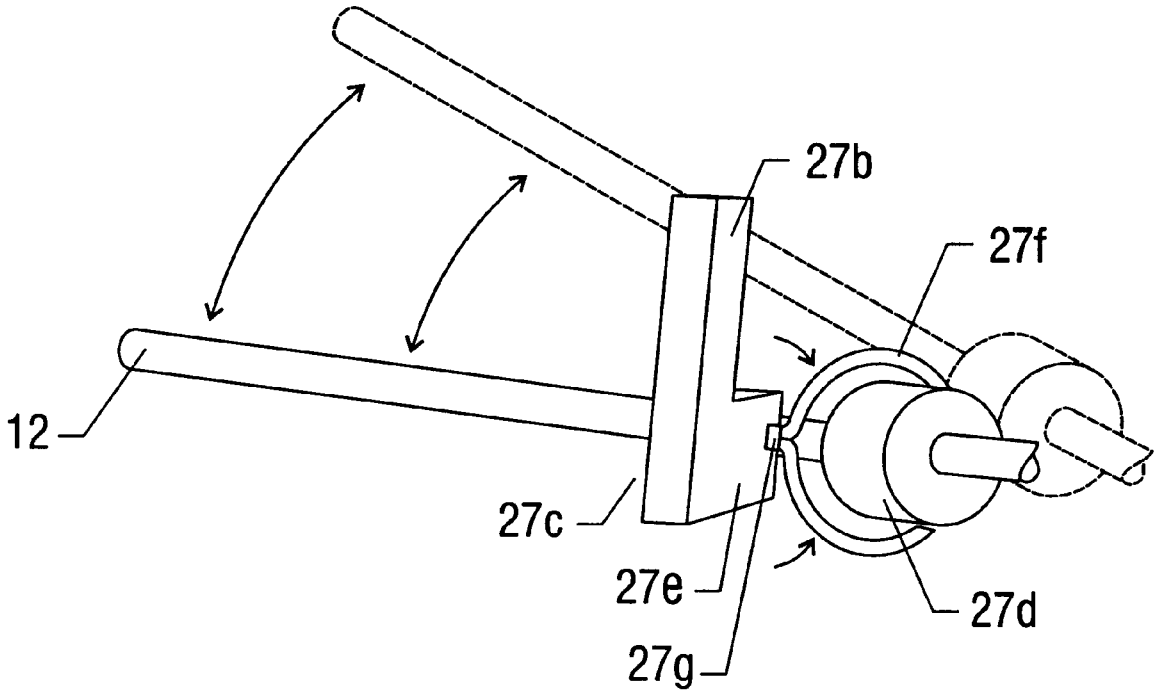
FIG. 18 is a simplified perspective view of a removal block and roll removal end of an overhead trolley extension according to one embodiment of the disclosed method and apparatus.

FIG. 18 shows an alternate embodiment of the roll removal end 27*c* of roll removal extension 27*b*, which is configured to releasably engage roll removal block 27*d* using block engager 27*e*. Roll removal block 27*d* is typically a Teflon cylinder having an internal diameter complementary to the outer diameter of shaft 12 in order to allow block 27*d* to be slidably received on shaft 12. In this regard, block 27*d* typically has an internal diameter of about 3 inches, although internal diameters suitable for use with larger or smaller winding shafts are also possible. Outer dimensions of block 27*d* may be of any suitable dimension to allow block 27*d* to engage and move wound rolls 18 toward the end of shaft 12, most typically about 3.75", when block 27*d* is a cylinder. Block engager 27*e* may be any suitable device for releasably engaging block 27*d*, but is most typically comprised of engagement arms 27*f* having a shape complementary to block 27*d* and mounted on or coupled to a pneumatic actuator 27*g* as shown. Typically actuator 27*g* is a pneumatic air cylinder such as is available from Numatics of Salina, Kans. Engagement arms 27*f* may be configured in any manner suitable for engaging or holding a block 27*d*, example with single or three or more arms rather than two arms, or arms that have other shapes and/or configurations. Engagement arm 27*f* may also be a pin for engagement in a hole or socket in block 27*d*.

As shown in FIG. 18, when pivotable shaft 12 is in outward unloading position, engagement arm 27*f* functions to engage and hold or grab block 27*d* so that it may be transported toward the end of shaft 12 and back by the motion of extension 27*b*. In this way wound rolls 18 may be transported off shaft 12 and shaft 12 prepared to receive cores 24. In this embodiment, engagement arm 27*f* also functions to release block 27*d* so that pivotable shaft 12 may pivot inward to winding position to allow cores 24 to be wound, as illustrated in FIG. 18. In multiple shaft winder applications, an engaging block 27*d* is typically provided for each shaft, a block 27*d* remaining with each shaft at all times.

Figure 14:
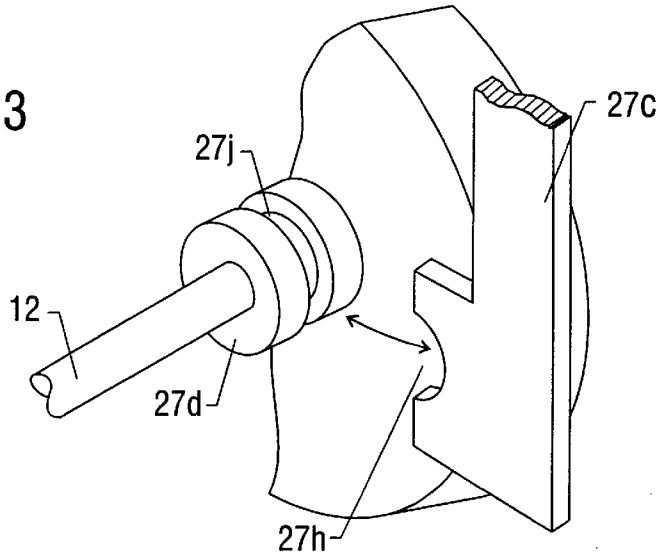
FIG. 14 is a simplified perspective view of a removal block and roll removal end of an overhead trolley extension according to one embodiment of the disclosed method and apparatus.

Although FIG. 18 illustrates one embodiment of a roll removal end 27*c* having a Teflon roll removal block 27*d* and block engagement arm 27*f*, other embodiments are possible. In this regard, any suitable device and/or method for contacting or engaging wound rolls 18 for mechanical transportation off of shaft 12 may be employed. FIG. 14 illustrates an example of one such embodiment having a removal block 27*d* with integral receiving slot 27*j* and a roll removal end 27*c* having a recess 27*h* adapted to be received in slot 27*j*. In other embodiments, engagement blocks made of materials other than Teflon, such as wood, plastic, metal, etc. may be employed. In addition, engagement blocks having any other shape (e.g., cubic, triangular, etc.) may be suitably employed. Furthermore, as an alternative to an engagement block 27*d*, roll removal end 27*c* may be equipped with alternate configurations for engaging and moving wound rolls 18 including, but not limited to, an arm, plate, or other suitably shaped extension.

An overhead trolley 26 is typically employed as a roll remover in the illustrated embodiment and offers the advantage of automatic roll removal without the necessity of equipment on the floor or otherwise positioned around a winding system in the way of operation personnel. Such an advantage may be realized with other configurations employing other types of roll removal devices configured in overhead relationship with a winder shaft, for example devices employing rodless air cylinders and other types of actuators know in the art to move a roll removal end. It will also be understood with benefit of the present disclosure that any other suitable device or apparatus positioned in operative relationship with a winder shaft may be employed as a roll remover to remove wound rolls from a winder shaft. Other examples of suitable roll removers include, but are not limited to, a ram or other suitable device positioned in operative relationship with a winder shaft and adapted to travel on a floor, side, or top mounted rail, belt, chain, rodless air cylinder or other suitable displacement device, and having a roll removal end or other surface adapted to contact and remove rolls from a winder shaft.

In the practice of the disclosed method and apparatus, any method and/or equipment suitable for controlling operation of various components of the disclosed winder/unloading-loading system combination may be employed. Such methods and equipment, both digital and analog based, are known in the art. For example, components of a winder 16 (such as the turret, pivotable shaft, and winding equipment of a cantilevered winder) are typically controlled by a winder system controller. As such, the steps of core winding, turret rotation and shaft pivoting are typically controlled automatically. In the practice of the disclosed unloading and reloading system, operation of various unloading and reloading components (including, for example, core conveyor 50, core loading ram 32, roll conveyor 14, and movable pivoting frame 70 or movable reciprocating frame 120) may be controlled by an unloading/loading system controller that may be, for example, a digital or analog signal processor that is in signal communication with various other devices, including a winder system controller, using control methods known to those of skill in the art. Typically, an unloading/loading system controller is a digital signal processor.

As an example, an unloading/loading system controller may be employed to receive input signals from limit switches that indicate or confirm operation, position or state of one or more components of the system. For example, a proximity switch is typically mounted to pivotable shaft 12 for sensing when shaft 12 is positioned in an angular outward unloading position. An unloading/loading system controller may also be employed to produce output control signals for controlling electric or electronic control devices (such as motor relays or solenoids) which serve to actuate drive devices (such as electric motors, pneumatic or hydraulic actuators, etc.) in specified sequence and/or in response to input signals representative of the state of other components in the system. In other embodiments, analog controller or manual control equipment may also be employed to perform operations in a similar manner. In any case, operation of the disclosed unloading and reloading equipment is typically controlled to respond to the winding operations of an associated winder such as for example, a single turret two shaft cantilevered turret winder, as described below. Most typically, an Allen Bradley "PLC 5" in signal communication with a winder system controller is employed as an unloading/loading system controller to control operation of the disclosed unloading and reloading system.

Figure 23:
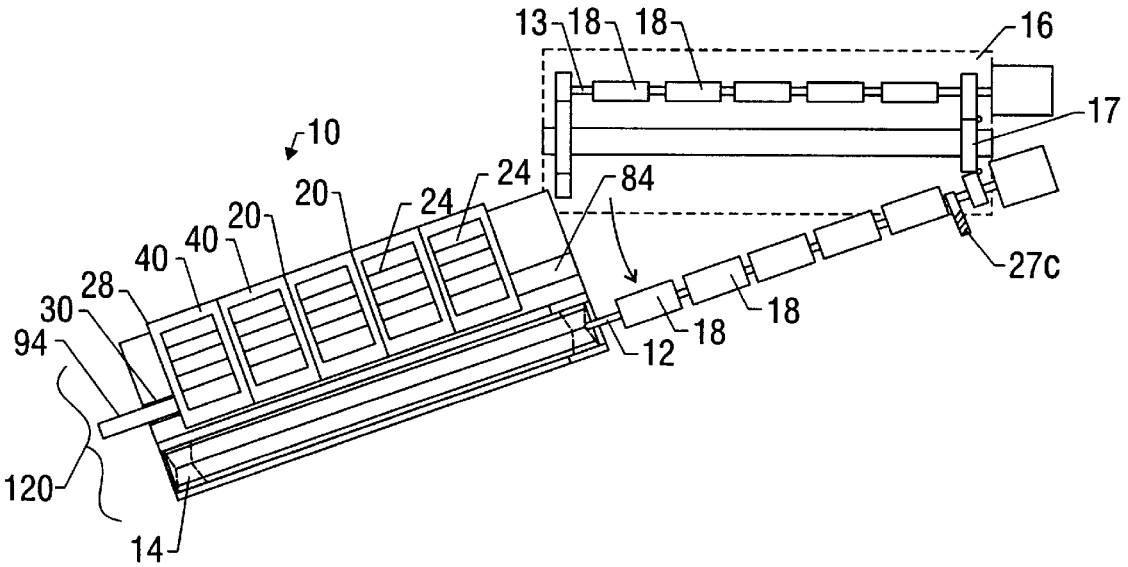
FIG. 23 is a simplified overhead view showing an arrangement of a core carriage, core rack, roll conveyor, reciprocating frame and winder according to one embodiment of the disclosed method and apparatus.

Referring to FIGS. 1–6 and 23–28, one embodiment of the disclosed unloading-loading method proceeds as follows. In this regard, FIGS. 1–6 illustrate the use of this method with a movable pivoting frame 70 that is configured to pivot about its lower end at a frame pivot point in conjunction with an associated core conveyor 50 and carriage 28 as previously described FIGS. 23–28 illustrate use of this method with a movable reciprocating frame 120 that is configured to move back and forth within carriage 28 in conjunction with associated core opening 122 as previously described. However, it will be understood that this method may be employed with movable frames configured to move in other ways as well. FIGS. 1 and 23 show pivotable shaft 12 of winder 16 loaded with wound rolls 18, placed in an outside winder station, and pivoted in angular outward loading position for roll removal. In this embodiment, the winder system controller is typically in communication with the unloading/loading system controller and, when shaft 12 is in this position, is placed in a holding state, waiting for a signal from the unloading/loading system before initiating the next turret rotation cycle. At this time, core rack 30 and roll conveyor 14 are empty, and movable pivoting frame 70 of FIG. 1 (or movable reciprocating frame 120 of FIG. 23) is positioned in its inward or first position so that roll conveyor 14 is axially aligned with shaft 12 and wound rolls 18 as shown in FIGS. 1 and 8 (or as shown in FIG. 23 for movable reciprocating frame 120). Also at this time trolley 27 is in a position adjacent the turret end of shaft 12 such that roll removal end 27*c* is positioned between the turret end of shaft 12 and the innermost wound roll 18.

Figure 24:
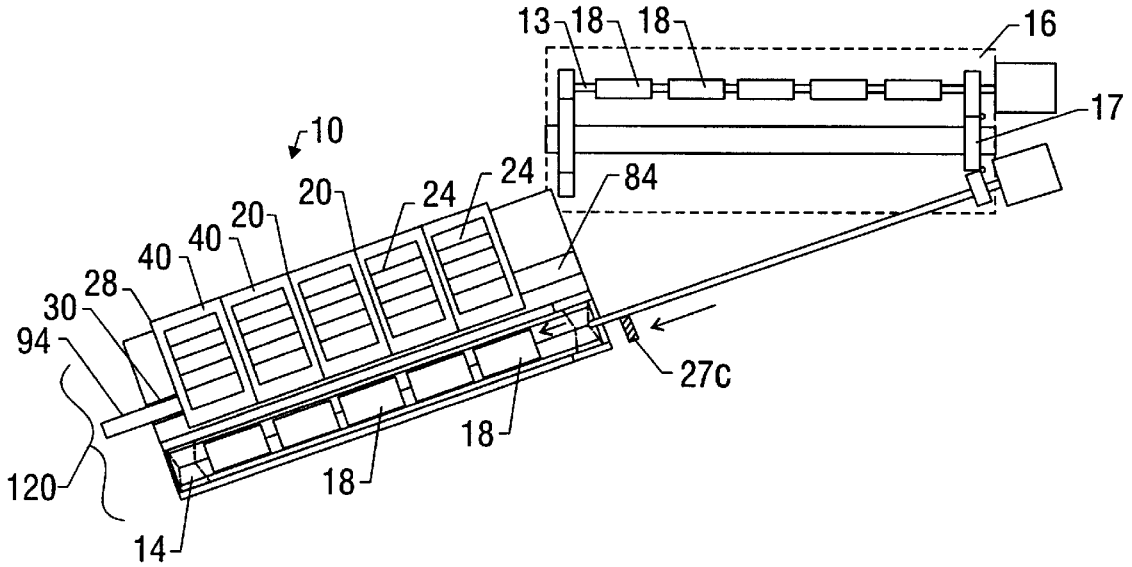
FIG. 24 is a simplified overhead view showing an arrangement of a core carriage, core rack, roll conveyor, reciprocating frame and winder according to one embodiment of the disclosed method and apparatus.

When the above described condition of shaft 12 and movable pivoting frame 70 (or movable reciprocating frame 120) is sensed by the unloading/loading system controller, for example, by receipt of a signal from a proximity switch, an output signal is sent by the unloading/loading system controller to activate overhead trolley 26, causing trolley 16 to move across trolley rail 27 towards carriage 28. In those embodiments employing a block engager 27*e* and removal block 27*d*, an output signal is also sent to activate block engager 27*e* so that block engagement arm 27*f* is caused to engage removal block 27*d* prior to movement of trolley 27. As shown in FIGS. 2 and 24, this action of trolley 26 causes removal end 27*c* of trolley extension 27*b* to move so that it contacts the innermost wound roll 18, thereby mechanically pushing rolls 18 onto roll conveyor 14 which mechanically receives and conveys rolls 18 away from the end of shaft 12, after which trolley 26 moves back to its original position so that shaft 12 is ready to receive additional cores 24 for winding.

In the case of embodiments employing movable pivoting frame 70, at the same time rolls 18 are removed from shaft 12 and conveyed by conveyor 14 the unloading/loading system controller activates core conveyor 50, which rotates sufficiently to cause one tray 54 to move to position opposite carriage opening 60 in such a way as to mechanically deposit a new row of cores 24 from carriage 28 onto core rack 30 in preparation for mechanical loading onto pivotable shaft 12, as illustrated in FIG. 2 and 8. Conveyor 50 then stops and remains stationary until the next core loading cycle. In this regard, FIG. 8 is a schematic sectional view of carriage 28 and movable pivoting frame 70, showing cores 24 stored within carriage 28 and a row of cores 24 positioned on core rack 30. It will be understood with benefit of this disclosure that positioning and operation of pivotable shaft 12 and overhead trolley 26 may be the same for the embodiments depicted in FIGS. 21–30 that employ a movable reciprocating frame 120 rather than a movable pivoting frame 70 and core conveyor 50. However, in the case of a movable reciprocating frame embodiment, a row of new cores 24 are automatically deposited in core rack 30 through core opening 122 and core recess 126 when reciprocating frame 120 is moved to its inward position as shown in FIG. 21A and as previously described. Advantageously, this eliminates the need for a separate control step to activate a core conveyor or other mechanical type of core feeder to place fresh cores in a core rack or core loader.

FIG. 7 is a side view of an unloading-reloading system having a movable pivoting frame 70 at the point just prior to unloading of wound rolls 18. In this regard, the pivotable shaft 12 is shown in relation to overhead trolley 26 which is shown in position to unload wound rolls 18. Also visible in FIG. 7 is carriage 28, core rack 30, roll conveyor 14, and adjustable dividers 20 which provide spaces or bins 40 for cores 24. As mentioned above, positioning and operation of a pivotable shaft 12 and overhead trolley 26 may be the same for a method employing movable reciprocating frame embodiments of FIGS. 21–30.

Figure 25:
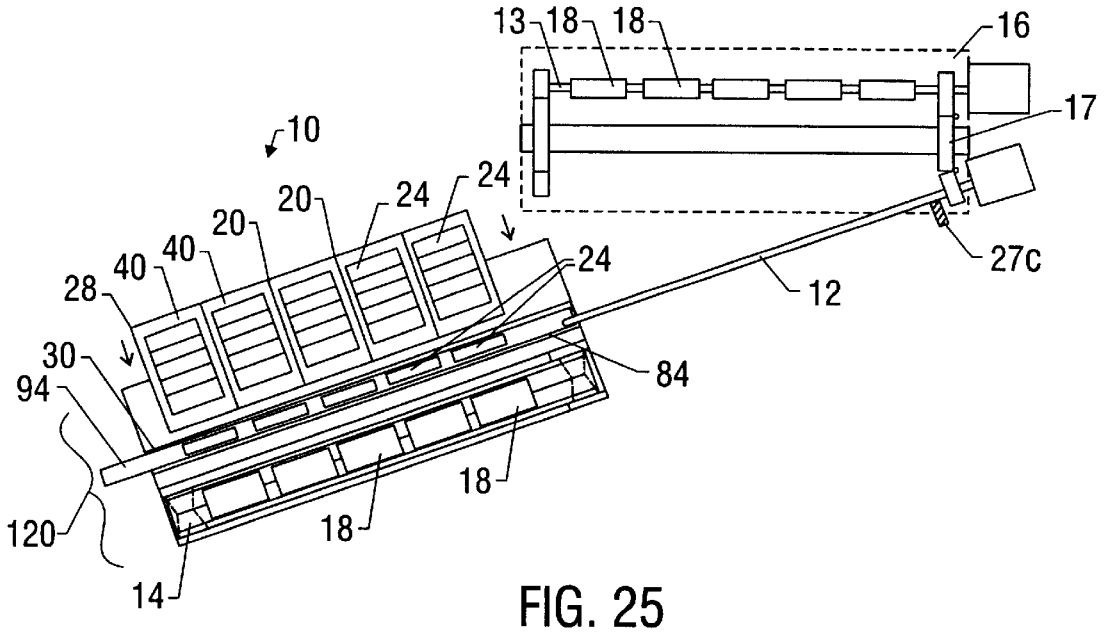
FIG. 25 is a simplified overhead view showing an arrangement of a core carriage, core rack, roll conveyor, reciprocating frame and winder according to one embodiment of the disclosed method and apparatus.

Next, as shown for movable pivoting frame 70 in FIGS. 3 and 9, once core conveyor 50 has moved into position to deposit one or more rows of cores 24 on core rack 30 and trolley 26 has moved into position to deposit one or more wound rolls 18 on roll conveyor 14, the unloading/loading system controller causes movable pivoting frame 70 to move to its outward or second position in which core rack 30 is axially aligned with shaft 12. FIG. 9 is a schematic sectional end view of carriage 28 and movable pivoting frame 70, showing cores 24 in position to be pushed onto a winder shaft 12 and wound rolls 18 positioned on roll conveyor 14. FIGS. 25 and 22 illustrate corresponding views of the same step in an embodiment employing a movable reciprocating frame 120, in which the unloading/loading system controller causes movable reciprocating frame 120 to move to its outward or second position in which core rack 30 is axially aligned with shaft 12 after trolley 26 has moved into position to deposit one or more wound rolls 18 on roll conveyor 14.

Figure 5:
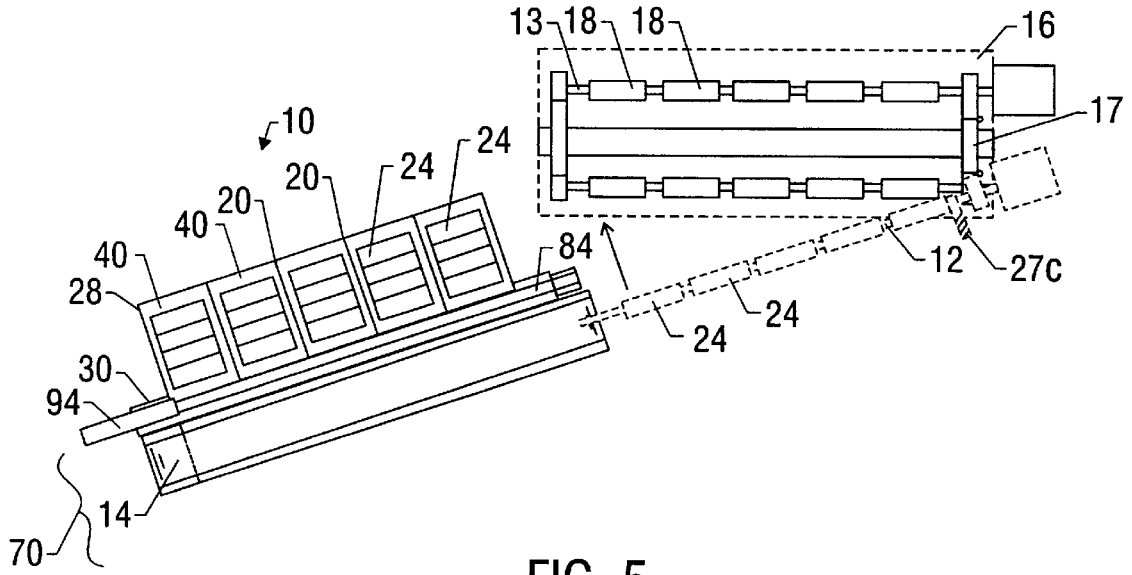
FIG. 5 is a simplified overhead view showing an arrangement of a core carriage, core rack, roll conveyor, movable frame and winder according to one embodiment of the disclosed method and apparatus.
Figure 26:
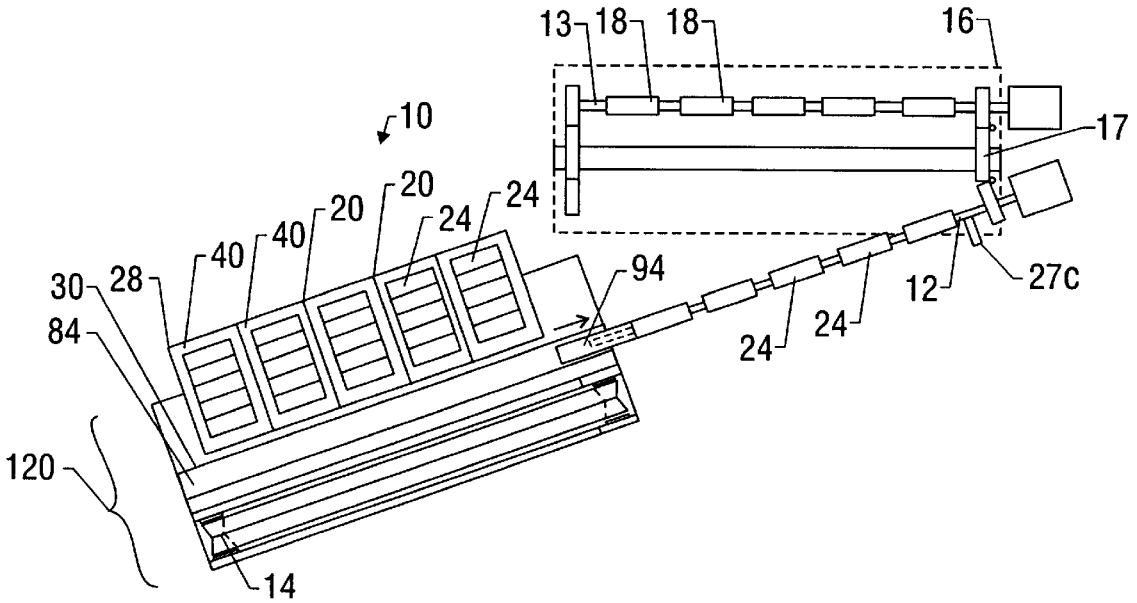
FIG. 26 is a simplified overhead view showing an arrangement of a core carriage, core rack, roll conveyor, reciprocating frame and winder according to one embodiment of the disclosed method and apparatus.
Figure 27:
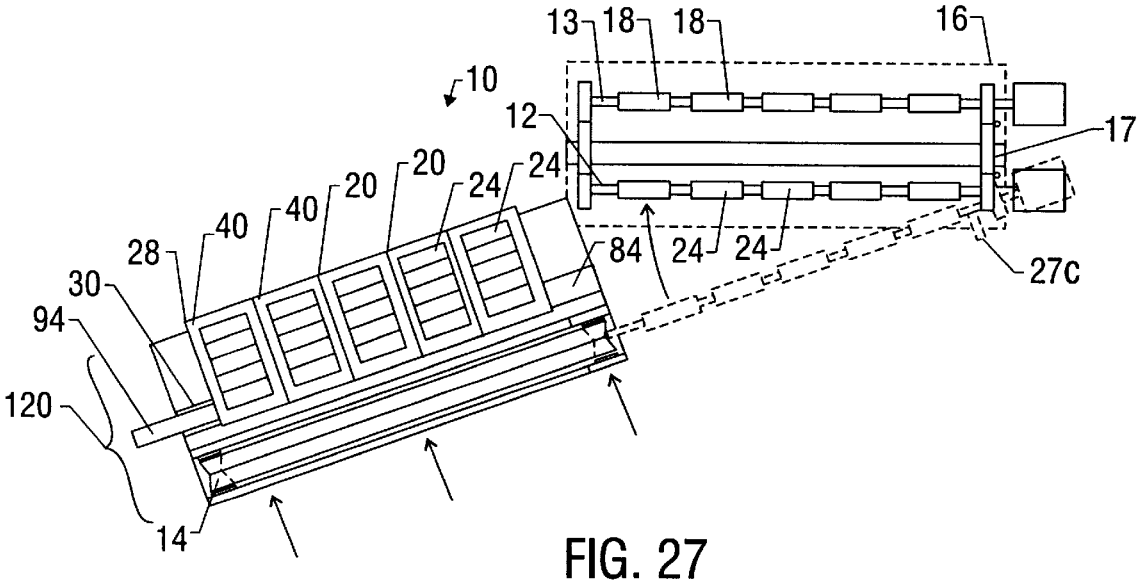
FIG. 27 is a simplified overhead view showing an arrangement of a core carriage, core rack, roll conveyor, reciprocating frame and winder according to one embodiment of the disclosed method and apparatus.
Figure 28:
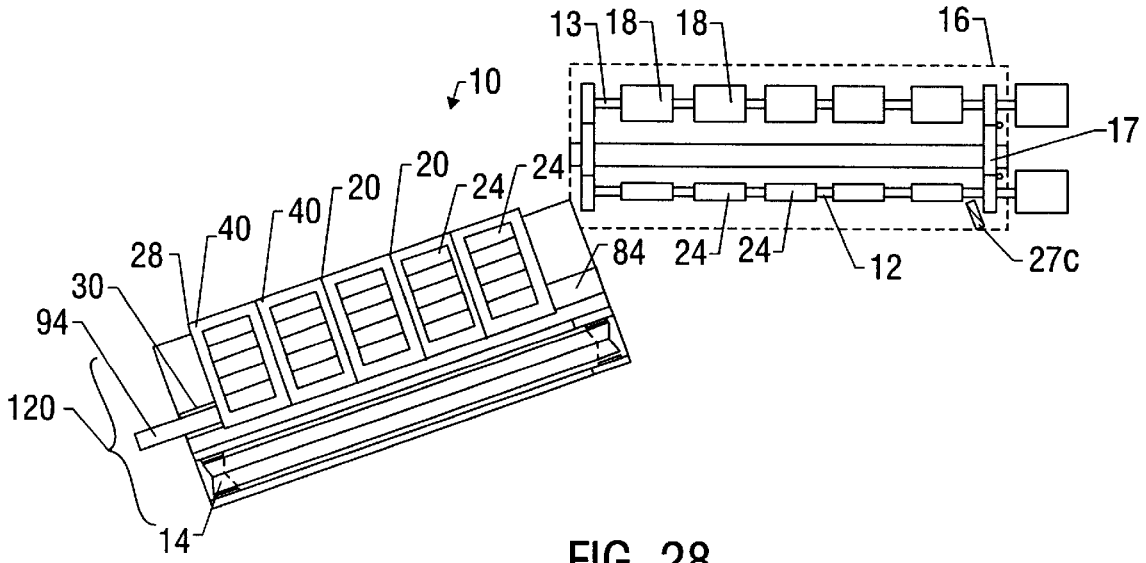
FIG. 28 is a simplified overhead view showing an arrangement of a core carriage, core rack, roll conveyor, reciprocating frame and winder according to one embodiment of the disclosed method and apparatus.

FIG. 4 and 26 respectively show the core loading step for the movable pivoting frame and movable reciprocating frame embodiments, which occurs next. Core ram head 94 of core ram 32 is activated by the unloading/loading system controller to move in a direction toward shaft 12 so as to mechanically push cores 24 onto shaft 12, and then to return to its original position so that core rack 30 is ready to receive the next layer of cores 24. At this point, if a block engager **27*e* is employed, engagement arm 27*f* is activated so as to release engagement block 27*d*. After the cores have been loaded, the unloading/loading system controller sends an output signal to the winder system controller to initiate another turret rotation. In response, as shown in FIGS. 5 and 27, pivotable winding shaft 12, now loaded with cores 24, is caused to pivot back into winder 16 and movable pivoting frame 70 (in the embodiment of FIG. 5) or movable reciprocating frame 120 (in the embodiment of FIG. 27) is activated to move back to its first position so that core rack 30 is once again positioned adjacent carriage opening 60 (in the embodiment of FIG. 5), or aligned with core opening 122 (in the embodiment of FIG. 27). At this time winder turret 17 rotates as indicated in FIGS. 6 and 28 to put shaft 12 loaded with empty cores 24 into an inside winder station within winder 12 for winding, and to place corresponding shaft 13 loaded with wound rolls 18 into an outside winder station from where it may be swung out for unloading. Shaft 13 pivots outward and winder system controller waits once again for the next signal from the unloading/loading system controller to initiate the next turret rotation cycle, and the process is then repeated as described above. Typically, sufficient time is given to allow wound rolls 18 to cease spinning prior to being removed from a winder shaft by trolley 26**.

Although the above described embodiment employs separate winder system and unloading/loading system controllers, it will be understood with benefit of the present disclosure that other controller configurations may be employed including, but not limited to, other schemes of interfacing and coordinating the actions of the two controllers or a single controller for controlling both the winder and the unloading/loading systems. Furthermore, alternate control steps, alternate sensing means, and/or any other suitable sensors or control system configurations known to those of skill in the art may be employed to sense and/or control the actions and steps of the disclosed unloading and reloading system and/or associated winder system to accomplish the mechanical unloading and reloading of a winder shaft as described herein. Possible alternatives include manual control by human operator/s or control by a combination of manual and system controller methods.

As understood with benefit of the present disclosure, the disclosed method and apparatus relates to a system for the automatic mechanical unloading of wound production rolls of sheet material, such as plastic film, from a winder shaft, and for the automatic reloading of cores onto the winder shaft. Advantageously, the automatic and mechanical nature of the system allows rapid replacement of a plurality of axially aligned wound rolls with a plurality of axially aligned cores in a time period of less than about a minute or less, thereby greatly increasing the efficiency of winding operations. Therefore the disclosed method and apparatus provide a system in which, among other things, one or more cores may be automatically and mechanically loaded on a winder shaft so that the cores may be wound with sheet material within a winding machine to produce wound rolls of sheet material which may then be automatically and mechanically removed from the winder shaft and replaced with cores again. Embodiments of the disclosed method and apparatus therefore provide a one step core loading system.

Automatic mechanical loading of cores is typically accomplished using a core loader for moving or conveying cores in a longitudinal direction onto a winder shaft. Such a core loader may include, for example, an elongated core loading rack that may be movably positioned in alignment with a winder shaft and which employs a core ram operating on a core rail to contact and move the cores. A core conveyor or other core supply device is typically employed to take cores from a core storage carriage onto the core rack in order to prepare the core rack for the next core loading cycle. Automatic mechanical unloading of wound rolls of sheet materials is typically accomplished with a roll remover comprising, for example, an overhead trolley or other suitable removal device that is capable of moving or conveying wound rolls in a longitudinal direction off of the winder shaft for further handling. In this regard, a roll conveyor which transports the wound rolls away from the end of the shaft may be employed. As part of the roll removal operation, a roll remover may optionally be configured to releasably operate on, or in conjunction with, a roll removal block having an opening with an internal diameter complementary to the outer diameter of a winder shaft so that it may be slidably positioned on a winder shaft and manipulated by the action of the roll remover so as to move wound rolls off the end of the shaft. To facilitate automatic mechanical operation, a roll conveyor and core loader may be adjacently positioned on a moveable platform, such as a movable pivoting frame or movable reciprocating frame, so that the roll conveyor and core loader may alternately be aligned with the winder shaft according to the particular step of the operation being performed.

Although particular embodiments of the disclosed loading-unloading method have been described and illustrated, it will be understood with benefit of the present disclosure that other embodiments are possible as well. For example, the sequence of any given individual function may be varied to occur in a different order and/or to occur simultaneously with other functions. As a specific example, cores may be loaded onto a core rack before or after a set of wound rolls are removed from a winder shaft by a roll remover rather than simultaneously with such an operation, including at a time neither winder shaft is in an outward angular position. Furthermore, benefit may be obtained from the disclosed method and apparatus with the variation or omission of some mechanical functions and/or equipment combinations as described above. For example, a movable frame with core rack and roll conveyor may be employed to unload and load a winder shaft without the use of a carriage and/or core feeder or core opening, but with other devices or systems for loading cores onto the core rack in preparation for loading onto a shaft. It will be understood with benefit of the present disclosure that other combinations of the disclosed methods and apparatus are possible. For example, embodiments employing more than one roll conveyor and/or core rack, and/or having a movable frame that may be actuated between more than two positions are possible. This is possible, for example, in cases where multiple roll conveyors may be used to convey wound rolls to different destinations. Furthermore, embodiments employing more than one movable frame may be employed, such as those having a movable frame positioned on opposite sides of a core carriage, for simultaneous and/or alternate use in loading and unloading one or more winder shafts. Finally, it will be understood with benefit of this disclosure that the term "movable frame" includes any device or configuration suitable for supporting a core loader and/or roll conveyor, and for performing functions described herein.

Although the disclosed method and apparatus is typically employed to load cores on a winder shaft and remove wound rolls from the shaft, it will be understood with benefit of the present disclosure that the terms "unloading," "loading," and "reloading," when applied to operations involving a winder shaft, may encompass any loading, unloading or reloading operations involving any combination of cores, partially wound rolls or fully wound rolls. For example, cores may be loaded and partially wound rolls unloaded, partially wound rolls may be loaded and fully wound rolls unloaded, etc. In this regard, the term "rolls" means a partially wound or fully wound roll. Furthermore, a winder shaft may be loaded, unloaded or reloaded with any component other than cores or rolls that is known in the art to be suitable for use or placement on a winder shaft.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed structures and methods may be utilized in various combinations and/or independently. Thus, the invention is not limited to only those combinations shown herein, but rather may include other combinations.

What is claimed is:

1. A winder shaft unloading and loading apparatus, comprising:

a frame, said frame being movable between first and second positions;

a core loader connected to said frame, said core loader including a core loading rack;

a roll conveyor connected to said frame, said roll conveyor being positioned proximate said core loader;

a core carriage adapted to contain cores, said core carriage being operable to dispense cores from within said core carriage to said core loader when said frame is in said first position; and a roll remover positioned in operative relationship with said shaft of said winder.

2. The apparatus of claim 1, wherein said frame is movable in a reciprocating direction.

3. The apparatus of claim 1, wherein said frame is adapted to be positioned adjacent a free end of a shaft of said winder such that said core loader and said roll conveyor may be alternately axially aligned with said free end of said winder shaft by moving said frame between said first and second positions.

4. The apparatus of claim 1, wherein said core carriage comprises one or more bins having a bin bottom, said bin bottom having a core opening defined therein and operable to gravity feed cores from within said core carriage to said core loader when said frame is in said first position.

5. The apparatus of claim 1, wherein said roll conveyor and said core loader are disposed vertically such that a roll on the roll conveyor when the frame is in the first position, and a core on the core loader when the frame is in the second position, have substantially the same longitudinal axes.

6. The apparatus of claim 1, wherein said winder shaft has a fixed end and a free end;

wherein said roll remover comprises an overhead trolley and a roll removal end, said roll removal end being connected to said overhead trolley and being disposed adjacent said winder shaft; and wherein said overhead trolley is adapted to move in a path so that said roll removal end travels back and forth in a direction adjacent and parallel to said winder shaft between a position adjacent said fixed end of said winder shaft and a position adjacent said free end of said winder shaft.

7. The apparatus of claim 1, wherein said core loading rack comprises a core cradle having a longitudinal axis and first and second ends, said core cradle being adapted to receive cores from said core carriage; and wherein said core loader further comprises:

a core ram disposed in adjacent operative relationship with said core cradle;

a driver connected to said core ram, said driver being adapted to travel in a path along said cradle longitudinal axis and between said first and second ends of said core cradle to displace said cores from said cradle.

8. The apparatus of claim 1, wherein said frame has an upper end and a lower end, said frame being pivotable about its lower end and having an axis of pivot.

9. The apparatus of claim 1, wherein said core carriage comprises a container for said cores configured to store the cores stacked on their sides in generally parallel relation, said container including a core dispenser positioned in a wall of the container, and further comprising a core feeder that comprises an inclined core conveyor extending upward within the container configured to receive cores from said stack and to convey the received cores to said core dispenser; wherein said frame is vertically disposed and positioned alongside said container and said dispenser; wherein said lower end of said frame is pivotally mounted and said upper end of said frame is movable between a first position alongside said container and said dispenser and a second position away from said container and said dispenser; and wherein said core loader is disposed adjacent said upper end of said frame and is adapted to receive cores from said container when said frame is in said first position.

10. A method of unloading and loading a winder shaft, comprising:

providing an unloading and loading apparatus, comprising:

a frame, said frame being movable between first and second positions, a core loader connected to said frame, said core loader including a core loading rack, a roll conveyor connected to said frame, said roll conveyor being positioned proximate said core loader, a core carriage adapted to contain cores, said core carriage being operable to dispense cores from within said core carriage to said core loader when said frame is in said first position, and a roll remover positioned in operative relationship with said shaft of said winder; providing one or more rolls on said shaft;

positioning said frame so that said roll conveyor is axially aligned with said shaft and so that a row of cores are dispensed from said core carriage to said core loading rack;

axially moving said rolls from said shaft onto said roll conveyor with said roll remover;

positioning said frame so that said core loading rack is axially aligned with said winder shaft; and axially moving said cores from said core loading rack onto said shaft with said core loader.

11. The method of claim 10, wherein said frame is movable in a pivoting direction.

12. The method of claim 10, wherein said frame is movable in a reciprocating direction.

13. A winder shaft unloading and loading apparatus, comprising:

a frame having a first end and a second end defining a first axis therebetween, said frame being movable between first and second positions in a reciprocating direction in relation to said frame first axis;

a core loader connected to said frame in generally parallel relationship with said first axis of said frame, said core loader including a core loading rack;

a roll conveyor connected to said frame in generally parallel relationship with said first axis of said frame, said roll conveyor being positioned proximate said core loader;

a core carriage adapted to contain cores, said core carriage having a core opening defined therein, said core opening operable to dispense cores from within said core carriage to said core loader when said frame is in said first position; and a roll remover positioned in operative relationship with said shaft of said winder.

14. The apparatus of claim 13, wherein said reciprocating direction is substantially perpendicular to said first frame axis.

15. The apparatus of claim 13, wherein said frame is adapted to be positioned adjacent a free end of a shaft of said winder such that said core loader and said roll conveyor may be alternately axially aligned with said free end of said winder shaft by moving said frame in said reciprocating direction in relation to said frame first axis.

16. The apparatus of claim 13, wherein said core carriage comprises one or more bins having a bin bottom, said core opening being defined in said bin bottom and being positioned in operative relationship with said frame to simultaneously dispense a row of one or more cores from said bins to said core loader.

17. The apparatus of claim 13, wherein said core carriage comprises a container for said cores configured to store the cores stacked on their sides in generally parallel relation, said container including a core opening positioned in a bottom of said container; wherein said bottom is inclined downward toward said core opening to gravity feed said cores from said stack to said core loader; wherein said frame is disposed beneath said container; and wherein said core loader is disposed beneath said core opening to receive cores from said container when said frame is in said first position, and wherein said core loader is disposed alongside said container when said frame is in said second position.

18. The apparatus of claim 17, wherein said core loading rack of said core loader further comprises a core recess defined within said frame adjacent and coextensive to said core loading rack; said core recess adapted to receive a single row of cores from said core opening when said frame is in said first position; and wherein said frame further comprises a top which prevents additional cores from being dispensed from said core opening when said frame is moved from said first position to said second position.

19. The apparatus of claim 17, wherein said roll conveyor is positioned parallel to said core loader and is positioned alongside said core carriage when said frame is in said first and second positions; wherein said core loader is positioned between said core carriage and said roll conveyor when said frame is in said second position; wherein said roll conveyor is configured to support rolls and is operable to convey said rolls.

20. The apparatus of claim 13, wherein said frame is movably disposed within an interior space defined in said core carriage; and wherein said frame is movably connected to said core carriage.

21. The apparatus of claim 13, wherein said winder shaft has a fixed end and a free end;

wherein said roll remover comprises an overhead trolley and a roll removal end, said roll removal end being connected to said overhead trolley and being disposed adjacent said winder shaft; and wherein said overhead trolley is adapted to move in a path so that said roll removal end travels back and forth in a direction adjacent and parallel to said winder shaft between a position adjacent said fixed end of said winder shaft and a position adjacent said free end of said winder shaft.

22. The apparatus of claim 13, wherein said core loading rack comprises a core cradle having a longitudinal axis and first and second ends, said core cradle being adapted to receive cores from said core opening; and wherein said core loader further comprises:

a core ram disposed in adjacent operative relationship with said core cradle;

a driver connected to said core ram, said driver being adapted to travel in a path along said cradle longitudinal axis and between said first and second ends of said core cradle to displace said cores from said cradle.

23. A method of unloading and loading a winder shaft, comprising:

providing an unloading and loading apparatus, comprising:

a frame having a first end and a second end defining a first axis therebetween, said frame being movable between first and second positions in a reciprocating direction in relation to said frame first axis, a core loader connected to said frame in generally parallel relationship with said first axis of said frame, said core loader including a core loading rack, a roll conveyor connected to said frame in generally parallel relationship with said first axis of said frame, said roll conveyor being positioned proximate said core loader, a core carriage adapted to contain cores, said core carriage having a core opening defined therein, said core opening operable to dispense cores from within said core carriage to said core loader when said frame is in said first position, and a roll remover positioned in operative relationship with said shaft of said winder;

providing one or more rolls on said shaft;

positioning said frame so that said roll conveyor is axially aligned with said shaft and so that a row of cores are dispensed from said core carriage through said core opening to said core loading rack;

axially moving said rolls from said shaft onto said roll conveyor with said roll remover;

positioning said frame so that said core loading rack is axially aligned with said winder shaft; and axially moving said cores from said core loading rack onto said shaft with said core loader.

24. The method of claim 23, wherein said winder shaft is a winder shaft pivotable between a winding position and an outward unloading position, and wherein said frame is positioned so that said core loader and said roll conveyor may be alternately axially aligned with said free end of said winder shaft when said shaft is positioned in said outward unloading position, and further comprising:

placing said winder shaft in an outward unloading position prior to axially moving said rolls from said shaft; and placing said winder shaft in a winding position after axially moving said cores from said core loading rack onto said shaft.

25. The method of claim 24 wherein said shaft is a first pivotable shaft of a dual cantilevered shaft turret winder having first and second pivotable shafts and a turret, and further comprising:

rotating said turret to place said second shaft in an inside winder station and to place said first shaft in an outside winder station prior to placing said first shaft in outward unloading position; and rotating said turret to place said first shaft in an inside winder station and said second shaft in an outside winder station after placing said first shaft in winding position.

26. The method of claim 23, wherein said core carriage comprises one or more bins having a bin bottom, said core opening being defined in said bin bottom and being positioned in operative relationship with said frame to simultaneously dispense a row of one or more cores from said bins to said core loader.

27. The method of claim 23, wherein said winder shaft has a fixed end and a free end;

wherein said roll remover comprises an overhead trolley and a roll removal end, said roll removal end being connected to said overhead trolley and being disposed adjacent said winder shaft; and wherein said overhead trolley is adapted to move in a path so that said roll removal end travels back and forth in a direction adjacent and parallel to said winder shaft between a position adjacent said fixed end of said winder shaft and a position adjacent said free end of said winder shaft; and wherein said rolls are axially moved from said shaft onto said roll conveyor by moving said overhead trolley from said position adjacent said fixed end of said winder shaft to said position adjacent said free end of said winder shaft, thereby causing said roll removal end to contact said rolls and axially move said rolls onto said roll conveyor.

28. The method of claim 23, wherein said core loading rack comprises a core cradle having a longitudinal axis and first and second ends, said core cradle being adapted to receive cores from said core opening; and wherein said core loader further comprises:

a core ram disposed in adjacent operative relationship with said core cradle;

a driver connected to said core ram, said driver being adapted to travel in a path along said cradle longitudinal axis and between said first and second ends of said core cradle to displace said cores from said cradle.

29. A winder shaft unloading and loading apparatus, comprising:

a frame having an upper end and lower end, said frame being pivotable about its lower end and having an axis of pivot;

a core loader connected to said frame in generally parallel relationship with said axis of pivot of said frame, said core loader including a core loading rack;

a roll conveyor connected to said frame in generally parallel relationship with said axis of pivot of said frame, said roll conveyor being positioned proximate said core loader;

a core carriage adapted to contain cores;

a core feeder operable to dispense cores from within said core carriage to said core loader; and a roll remover positioned in operative relationship with said shaft of said winder.

30. The apparatus of claim 29, wherein said frame is adapted to be positioned adjacent a free end of a shaft of said winder such that said core loader and said roll conveyor may be alternately axially aligned with said free end of said winder shaft by pivoting said frame.

31. The apparatus of claim 29, wherein said core carriage comprises one or more bins and wherein said core feeder comprises a conveyor having one or more trays supported by one or more chain and sprocket conveyors, said core feeder being positioned in operative relationship with said core carriage to simultaneously dispense a row of one or more cores from said bins to said core loader.

32. The apparatus of claim 29, wherein said core carriage comprises a container for said cores configured to store the cores stacked on their sides in generally parallel relation, said container including a core dispenser positioned in a wall of the container; and wherein said core feeder comprises an inclined core conveyor extending upward within the container configured to receive cores from said stack and to convey the received cores to said core dispenser.

33. The apparatus of claim 32, wherein said frame is vertically disposed and positioned alongside said container and said dispenser; wherein said lower end of said frame is pivotally mounted and said upper end of said frame is movable between a first position alongside said container and said dispenser and a second position away from said container and said dispenser; and wherein said core loader is disposed adjacent said upper end of said frame and is adapted to receive cores from said container when said frame is in said first position.

34. The apparatus of claim 33, wherein said core loader is positioned between said core carriage and said roll conveyor; wherein said roll conveyor is positioned parallel to said core loader; and wherein said roll conveyor is configured to support said rolls and is operable to convey said rolls.

35. The apparatus of claim 32, wherein said inclined conveyor includes a plurality of trays disposed transversely along said core conveyor, each said tray being configured to receive a row of cores.

36. The apparatus of claim 34, wherein said roll conveyor and said core loader are disposed vertically such that a roll on the roll conveyor when the frame is in the first position, and a core on the core loader when the frame is in the second position, have substantially the same longitudinal axes.

37. The apparatus of claim 29, wherein said winder shaft has a fixed end and a free end;

wherein said roll remover comprises an overhead trolley and a roll removal end, said roll removal end being connected to said overhead trolley and being disposed adjacent said winder shaft; and wherein said overhead trolley is adapted to move in a path so that said roll removal end travels back and forth in a direction adjacent and parallel to said winder shaft between a position adjacent said fixed end of said winder shaft and a position adjacent said free end of said winder shaft.

38. The apparatus of claim 29 wherein said winder shaft is a winder shaft pivotable between a winding position and an outward unloading position, and wherein said frame is positioned so that said core loader and said roll conveyor may be alternately axially aligned with said free end of said winder shaft when said shaft is positioned in said outward unloading position.

39. The apparatus of claim 29, wherein said core loading rack comprises a core cradle having a longitudinal axis and first and second ends, said core cradle being adapted to receive cores from said core feeder; and wherein said core loader further comprises:

a core ram disposed in adjacent operative relationship with said core cradle;

a driver connected to said core ram, said driver being adapted to travel in a path along said cradle longitudinal axis and between said first and second ends of said core cradle to displace said cores from said cradle.

40. The apparatus of claim 39, wherein said driver is a rodless air cylinder having a longitudinal axis disposed in adjacent parallel relationship with said longitudinal axis of said core cradle.

41. The apparatus of claim 29, wherein said roll conveyor is a conveyor belt.

42. The apparatus of claim 29, further comprising an unloading/loading system controller programmable for controlling operation of said apparatus.

43. A method of unloading and loading a winder shaft, comprising:

providing an unloading and loading apparatus, comprising:

a frame having an upper end and lower end, said frame being pivotable about its lower end and having an axis of pivot, a core loader connected to said frame in generally parallel relationship with said axis of pivot of said frame, said core loader including a core loading rack, a roll conveyor connected to said frame in generally parallel relationship with said axis of pivot of said frame, said roll conveyor being positioned proximate said core loader, a core carriage adapted to contain cores, a core feeder operable to dispense cores from within said core carriage to said core loading rack, and a roll remover positioned in operative relationship with said shaft of said winder; and providing one or more rolls on said shaft;

positioning said frame about its pivot axis so that said roll conveyor is axially aligned with said shaft;

axially moving said rolls from said shaft onto said roll conveyor with said roll remover;

removing a row of cores from said core carriage and placing said cores on said core loading rack with said core feeder;

positioning said frame about its pivot axis so that said core loading rack is axially aligned with said winder shaft; and axially moving said cores from said core loading rack onto said shaft with said core loader.

44. The method of claim 43, wherein said winder shaft is a winder shaft pivotable between a winding position and an outward unloading position, and wherein said frame is positioned so that said core loader and said roll conveyor may be alternately axially aligned with said free end of said winder shaft when said shaft is positioned in said outward unloading position, and further comprising:

placing said winder shaft in an outward unloading position prior to axially moving said rolls from said shaft; and placing said winder shaft in a winding position after axially moving said cores from said core loading rack onto said shaft.

45. The method of claim 44 wherein said shaft is a first pivotable shaft of a dual cantilevered shaft turret winder having first and second pivotable shafts and a turret, and further comprising:

rotating said turret to place said second shaft in an inside winder station and to place said first shaft in an outside winder station prior to placing said first shaft in outward unloading position; and rotating said turret to place said first shaft in an inside winder station and said second shaft in an outside winder station after placing said first shaft in winding position.

46. The method of claim 43, wherein said core carriage comprises one or more bins and wherein said c ore feeder comprises a conveyor having one or more trays supported by one or more chain and sprocket conveyors, said core feeder being positioned in operative relationship with said core carriage to simultaneously dispense a row of one or more cores from said bins to said core loading rack.

47. The method of claim 43, wherein said winder shaft has a fixed end and a free end;

wherein said roll remover comprises an overhead trolley and a roll removal end, said roll removal end being connected to said overhead trolley and being disposed adjacent said winder shaft; and wherein said overhead trolley is adapted to move in a path so that said roll removal end travels back and forth in a direction adjacent and parallel to said winder shaft between a position adjacent said fixed end of said winder shaft and a position adjacent said free end of said winder shaft; and wherein said rolls are axially moved from said shaft onto said roll conveyor by moving said overhead trolley from said position adjacent said fixed end of said winder shaft to said position adjacent said free end of said winder shaft, thereby causing said roll removal end to contact said rolls and axially move said rolls onto said roll conveyor.

48. The method of claim 43, wherein said core loading rack further comprises a core cradle having a longitudinal axis and first and second ends, said core cradle being adapted to receive cores from said core feeder; and wherein said core loader further comprises:

a core ram disposed in adjacent operative relationship with said core cradle;

a driver connected to said core ram, said driver being adapted to travel in a path along said cradle longitudinal axis and between said first and second ends of said core cradle to displace said cores from said cradle.

49. The method of claim 48, wherein said driver is a rodless air cylinder having a longitudinal axis disposed in adjacent parallel relationship with said longitudinal axis of said core cradle.

50. The method of claim 43, wherein said roll conveyor is a conveyor belt.

51. The method of claim 43, wherein said unloading and loading apparatus further comprises an unloading/loading system controller and further comprising controlling said unloading and loading apparatus with said controller.

52. A winder shaft loading and roll conveying apparatus, comprising:

a core loader comprising a core mechanical displacement device operable to mechanically move cores onto a first end of said shaft;

a roll conveyor operable to mechanically transport rolls away from said first end of said shaft; and wherein said core loader and said roll conveyor are disposed in operative relationship such that said core loading rack and said roll conveyor may be alternately axially aligned with said first end of said winder shaft.

53. A core storing and dispensing apparatus, comprising:

a core carriage, said core carriage configured to hold at least two columns of cores stacked on their sides in generally parallel relation; and a core feeder positioned in operative relationship with said core carriage and adapted to simultaneously remove one core from each of said columns and to simultaneously dispense said cores removed from each of said columns in end to end relationship;

wherein said core feeder comprises a conveyor belt.

54. The core storing and dispensing apparatus of claim 53 wherein said conveyor belt has one or more trays disposed transversely along said conveyor belt, each said tray being configured to receive a row of cores.

55. A core storing and dispensing apparatus, comprising:

a core carriage, said core carriage configured to hold at least two columns of cores stacked on their sides in generally parallel relation; and a core feeder adapted to simultaneously remove one core from each of said columns and to simultaneously dispense said cores removed from each of said columns in end to end relationship;

wherein said core feeder comprises a conveyor belt positioned in operative relationship with said core carriage; or wherein said core feeder comprises a core opening defined in said core carriage, a reciprocating frame positioned beneath and adjacent to said core opening and movable between first and second positions, and a core recess defined in said reciprocating frame, said core recess adapted to receive a single row of cores by gravity feed from said core opening when said frame is in said first position, and wherein said reciprocating frame her comprises a top which prevents additional cores from being dispensed from said core opening when said frame is moved from said first position to said second position.

* * * * *